US006684826B2

(12) United States Patent
Yoshikawa et al.

(10) Patent No.: US 6,684,826 B2
(45) Date of Patent: Feb. 3, 2004

(54) ENGINE COOLING APPARATUS

(75) Inventors: Shigetaka Yoshikawa, Aichi-ken (JP); Yoshikazu Shinpo, Nissin (JP); Isao Takagi, Okazaki (JP); Daisuke Yamamoto, Obu (JP); Hiromichi Murakami, Obu (JP)

(73) Assignees: Toyota Jidosha Kabushiki Kaisha, Toyota (JP); Aisan Kogyo Kabushiki Kaisha, Obu (JP)

( * ) Notice: Subject to any disclaimer, the term of this patent is extended or adjusted under 35 U.S.C. 154(b) by 9 days.

(21) Appl. No.: 10/200,230

(22) Filed: Jul. 23, 2002

(65) Prior Publication Data

US 2003/0019442 A1 Jan. 30, 2003

(30) Foreign Application Priority Data

Jul. 25, 2001 (JP) ..... 2001-224669
Dec. 5, 2001 (JP) ..... 2001-370937

(51) Int. Cl.[7] ..... F01P 7/14
(52) U.S. Cl. ..... 123/41.1; 123/41.15; 123/41.57
(58) Field of Search ..... 123/41.1, 41.15, 123/41.58, 41.57, 198 D; 236/34.5

(56) References Cited

U.S. PATENT DOCUMENTS 3,907,199 A * 9/1975 Kreger ..... 237/12.3 B
5,529,026 A * 6/1996 Kurr et al. ..... 123/41.1
6,568,356 B1 * 5/2003 Hayakawa et al. ..... 123/41.1

FOREIGN PATENT DOCUMENTS

| | | |
|---|---|---|
| JP | A 2-125910 | 5/1990 |
| JP | A 5-179948 | 7/1993 |
| JP | A 10-317965 | 12/1998 |

* cited by examiner

*Primary Examiner*—Henry C. Yuen
*Assistant Examiner*—Katrina Harris
(74) *Attorney, Agent, or Firm*—Oliff & Berridge, PLC

(57) ABSTRACT

An engine cooling apparatus includes a flow regulating valve, which adjusts a flow rate of a coolant passing through a radiator provided in a coolant circulation passage of the engine, and an electronic control unit (ECU), which controls an opening of the flow regulating valve such that an engine outlet coolant temperature reaches a necessary target temperature. The ECU sets a basic opening as a feedforward term based on the operation state of the engine. The ECU calculates a final opening from an F/B constant as a feedback term, which is increased or decreased such that the engine outlet coolant temperature reaches the target temperature, and the basic opening. Further, the ECU performs feedback control on the opening of the flow regulating valve based on the final opening. As a result, the responsibility of the coolant temperature control is improved.

28 Claims, 15 Drawing Sheets

ENGINE COOLING APPARATUS

BACKGROUND OF THE INVENTION

The present invention relates to an engine cooling apparatus, which cools down an engine by circulating a coolant, and more particularly to an engine cooling apparatus, which controls the flow rate of the coolant that passes through a radiator provided in a coolant circulation passage of the engine.

As a conventional cooling apparatus provided in an engine, the most popular type has been one, which uniformly adjusts a coolant to a temperature of approximately 80° by a thermostat irrespective of an operation state of the engine. In order to achieve reduction in friction of the engine, improvement in fuel consumption or knocking performance and others, however, it is confirmed that changing a degree of cooling in accordance with an operation state of the engine (load condition, rotational speed or the like) is effective. Therefore, there have been proposed several cooling apparatuses designed to control a degree of cooling in accordance with an operation state of the engine.

As this type of cooling apparatus, for example, there is an engine cooling apparatus disclosed in Japanese Laid-Open Patent Publication No. 5-179948. This engine cooling apparatus is configured for the purpose of adjusting a temperature of a coolant that circulates in the engine in accordance with the load condition of the engine. That is, this apparatus is designed to set a target temperature of the coolant based on the load condition of the engine and controls a flow rate of the coolant that passes through a radiator in such a manner that a temperature of the coolant that flows on an outlet side of a water jacket reaches this target temperature. More specifically, a temperature difference between an actual coolant temperature detected by a coolant temperature sensor and the target temperature is obtained. Further, an amount of duty change is obtained from this temperature difference by making reference to map data, and a temperature of the coolant that flows on the outlet side of the water jacket is adjusted to the target temperature by controlling a flow regulating valve, which adjusts a flow rate of the coolant passing through the radiator, based on the amount of duty change.

In the prior art engine cooling apparatus in the above patent publication, since the flow regulating valve is merely controlled based on a temperature difference between the actual coolant temperature and the target temperature, there is a problem in the responsibility of the coolant temperature control conducted in order to adjust the coolant temperature to the target temperature. In particular, since the actual coolant temperature deviates from the target temperature in the transition of the operation state of the engine, there occurs a loss in terms of reduction in friction, improvement in fuel consumption or knocking performance and others during the transient operation of the engine.

SUMMARY OF THE INVENTION

It is an object of the present invention to provide an engine cooling apparatus capable of improving the responsibility of the coolant temperature control conducted in order to adjust a temperature of a coolant circulating in an engine to a target temperature.

To achieve the above object, the present invention provides an engine cooling apparatus including a circulation passage, a radiator, a flow regulating valve, and a controller. The circulation passage extends through an engine, and coolant flows through the circulation passage. The radiator is provided in the circulation passage and cools coolant passing through the circulation passage. The flow regulating valve regulates the flow rate of coolant flowing through the radiator. The controller controls the flow regulating valve. The controller sets a feedforward term, which corresponds to a basic opening of the flow regulating valve, based on the operation state of the engine. The controller sets a feedback term, which is adjusted such that the engine coolant temperature converges on a predetermined target value. The controller feedback controls the opening of the flow regulating valve based on the feedforward term and the feedback term.

The present invention also provides a method for controlling an engine cooling apparatus, which includes a coolant circulation passage extending through an engine. The method includes: cooling coolant passing through the circulation passage with a radiator provided in the circulation passage; regulating the flow rate of coolant flowing through the radiator with a flow regulating valve; setting a feedforward term based on the operation state of the engine, the feedforward term corresponding to a basic opening of the flow regulating valve; setting a feedback term, the feedback term being adjusted such that the engine coolant temperature, which is the temperature of coolant flowing through the engine, converges on a predetermined target value; and feedback controlling the opening of the flow regulating valve based on the feedforward term and the feedback term.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objectives and advantages thereof, may best be understood by reference to the following description of the presently preferred embodiments together with the accompanying drawings in which.

DETAILED DESCRIPTION OF THE PREFERRED EMBODIMENTS

A first embodiment, which embodies an engine cooling apparatus according to the present invention, will now be described in detail hereinafter with reference to the accompanying drawings.

Figure 1:
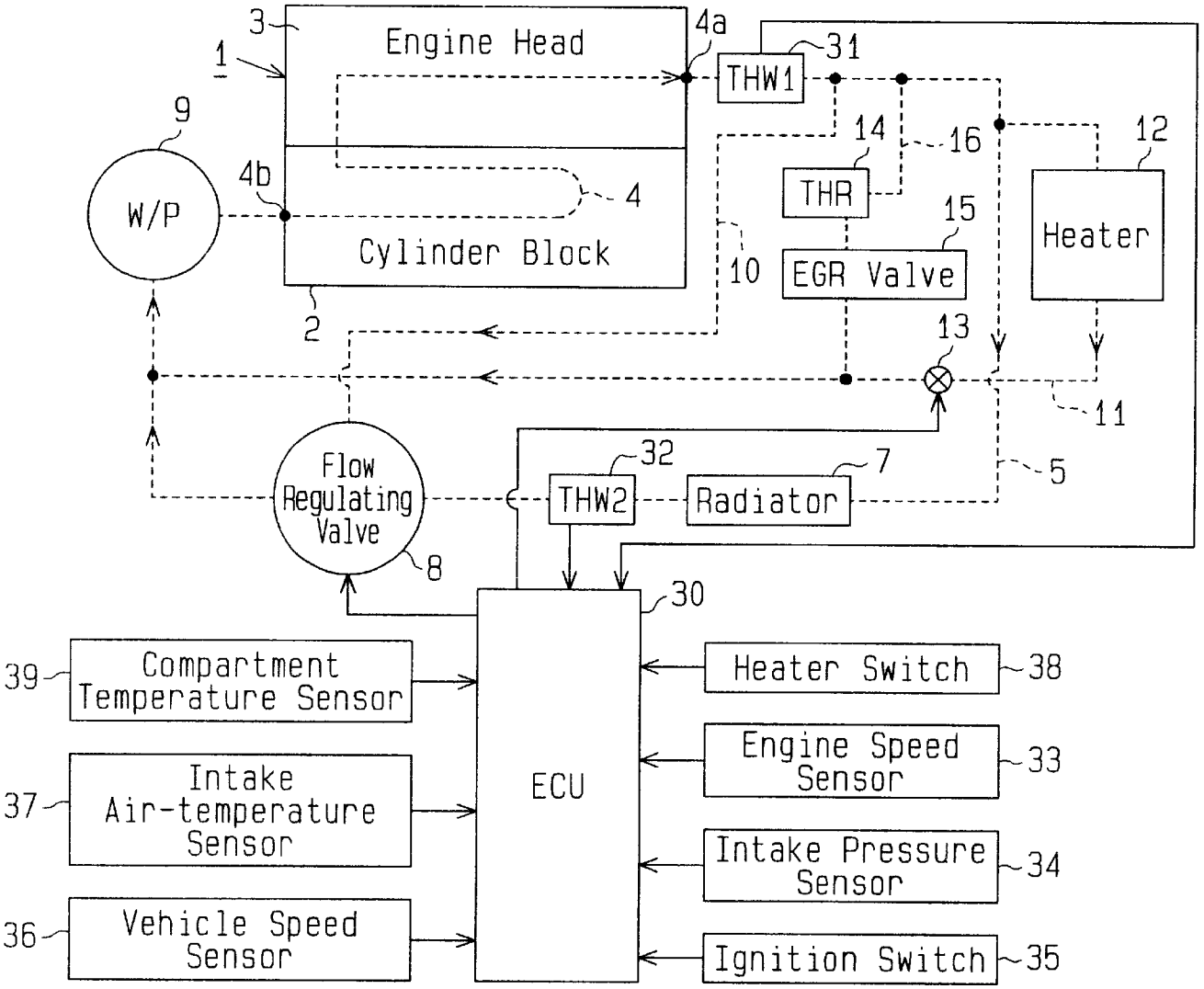
FIG. 1 is a schematic block diagram of an engine cooling apparatus according to a first embodiment of the present invention.

FIG. 1 shows a schematic structure of an engine cooling apparatus according to this embodiment. An engine 1 mounted in a vehicle includes a cylinder block 2 and an engine head 3. This cooling apparatus cools down the engine 1 by circulating a coolant, and a coolant passage 4 including a water jacket is provided to the cylinder block 2 and the engine head 3.

An outlet 4*a* and an inlet 4*b* of the coolant passage 4 are connected by a main piping 5, and the coolant passage 4 and the main piping 5 constitute a coolant circulation passage according to the present invention. There are provided a first coolant temperature sensor 31, a radiator 7, a second coolant temperature sensor 32, a flow regulating valve 8 and a water pump (W/P) 9 in this order in the middle of the main piping 5 from the outlet 4*a* toward the inlet 4*b*.

The first coolant temperature sensor 31 detects a temperature (engine outlet coolant temperature) THW1 of the coolant that flows out from the coolant passage 4 of the engine 1 at a position adjacent to the outlet 4*a*. The radiator 7 discharges a heat amount obtained by the coolant from the engine 1 by heat exchange. The second coolant temperature sensor 32 detects a temperature (radiator outlet coolant temperature) THW2 of the coolant that flows out from the radiator 7 at a position adjacent to the outlet of the radiator 7. The flow regulating valve 8 is electrically controlled in order to adjust a circulation flow rate of the coolant in the main piping 5. The water pump 9 operates by receiving power from the engine 1, and gives a flow to the coolant in the main piping 5.

A bypass piping 10 is provided between the main piping 5 and the flow regulating valve 8 in the vicinity of the downstream side of the first coolant temperature sensor 31. A heater piping 11 is provided between the main piping 5 and the water pump 9 in the vicinity of the downstream side of the first coolant temperature sensor 31. A heater 12, which warms up the passenger compartment of the vehicle by releasing an amount of heat of the coolant flowing in the piping 11, is provided in the middle of the heater piping 11. A shut-off valve 13, which is electrically controlled in order to shut off a flow of the coolant in the piping 11, is provided in the middle of the heater piping 11. The shut-off valve 13 consists of a solenoid valve and opens/closes a valve body in response to on/off signals.

A cooling piping 16, which cools or heats each of a throttle body (THR) 14 and an EGR valve 15, is provided between the main piping 5 and the heater piping 11 in the vicinity of the downstream side of the first coolant temperature sensor 31. The throttle body (THR) 14 and the EGR valve 15 are attachment devices of the engine 1.

Figure 2:
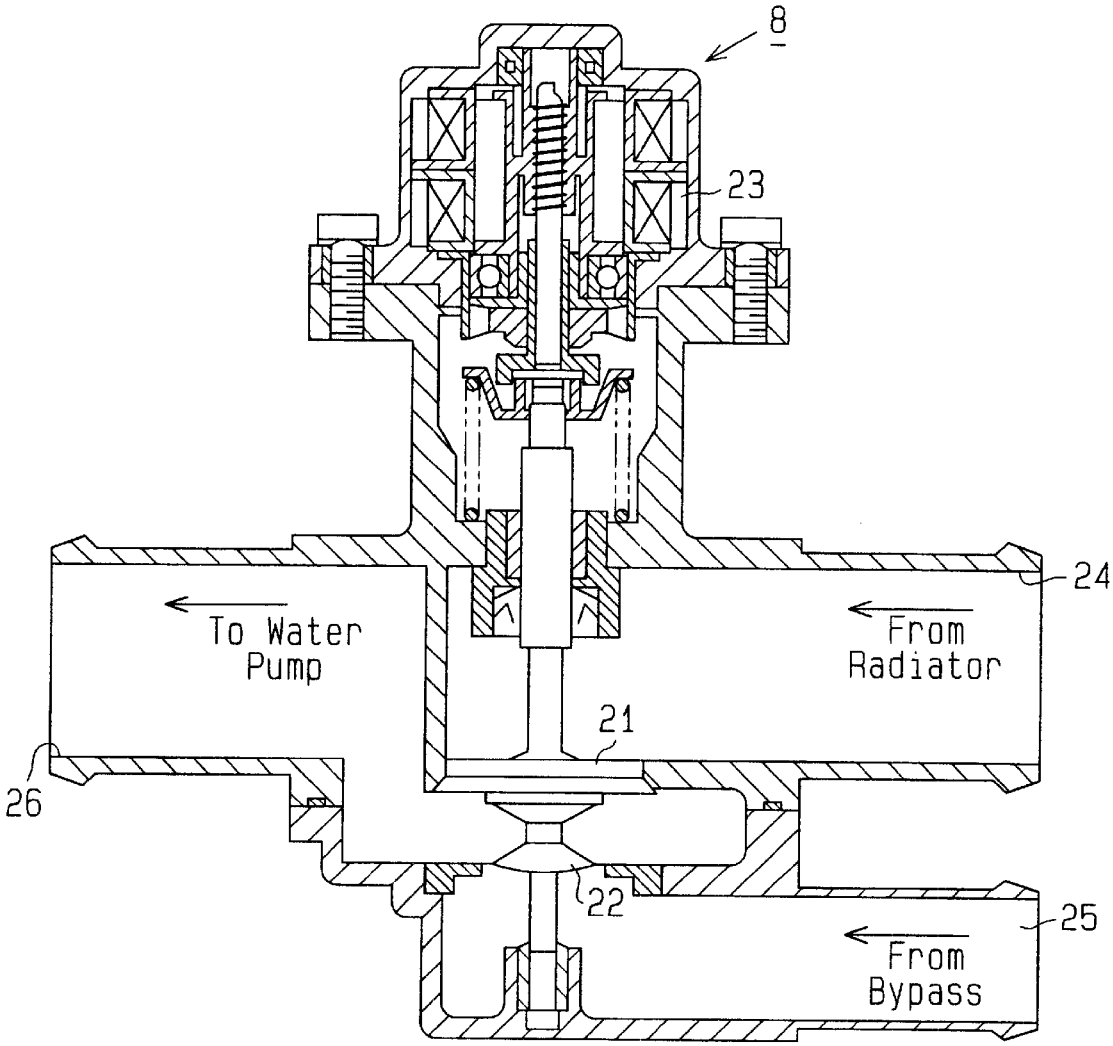
FIG. 2 is a cross-sectional view showing a flow regulating valve of FIG. 1.

FIG. 2 shows a cross-sectional structure of the flow regulating valve 8. The flow regulating valve 8 actuates two valve bodies 21 and 22 by a step motor 23 in order to adjust a flow rate of the coolant in the main piping 5 and the bypass piping 10. This flow regulating valve 8 includes first and second lead-in ports 24 and 25 and one lead-out port 26. The main piping 5 is connected to the first lead-in port 24, and the coolant that flows out from the radiator 7 is led into the first lead-in port 24. The bypass piping 10 is connected to the second lead-in port 25. The main piping 5 is connected to the lead-out port 26, and the coolant that flows out from the radiator 7 and the coolant that flows in the bypass piping 10 become confluent and flow into the main piping 10 through the lead-out port 26.

Figure 3:
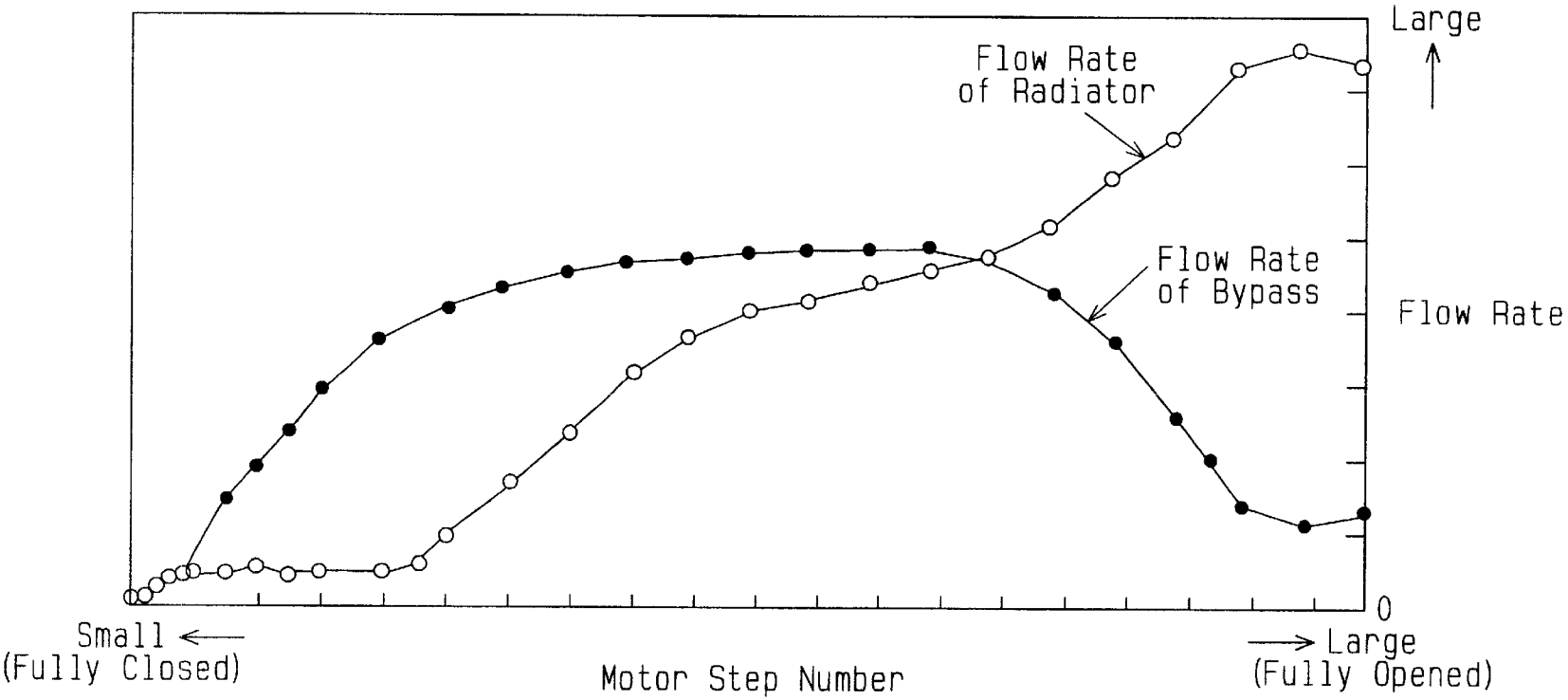
FIG. 3 is a flow rate characteristic view of the flow regulating valve of FIG. 2.

FIG. 3 is a graph showing a flow rate characteristic of the flow regulating valve 8. This graph shows a number of motor steps of the step motor, which correlates with a valve opening, in the horizontal axis, and a flow rate of the coolant in the vertical axis. As apparent from the graph, although a radiator flow rate of the main piping 5 gradually increases as the valve opening becomes large, it can be understood that the bypass flow rate of the bypass piping 10 increases/decreases with a given peak as the valve opening becomes large.

This cooling apparatus controls the degree of cooling the engine 1 by controlling the opening of the flow regulating valve 8 in accordance with the operation state of the engine 1 and adjusting a flow rate of the coolant passing through the radiator 7. Therefore, as shown in FIG. 1, this apparatus includes a controller, which is an electronic control unit (ECU) 30 in this embodiment. To the ECU 30 are connected to the shut-off valve 13, the first coolant temperature sensor 31, the second coolant temperature sensor 32 and the flow regulating valve 8. Furthermore, in order to fetch the operation state of the engine 1, to the ECU 30 are connected an engine speed sensor 33, an intake pressure sensor 34, an ignition switch (IGSW) 35, a vehicle speed sensor 36 and an intake air-temperature sensor 37. Besides, a heater switch 38 and a compartment temperature sensor 39 are connected to the ECU 30. The engine speed sensor 33 detects an engine speed NE and outputs a signal according to the detected value. The intake pressure sensor 34 is provided to an intake passage (not shown) of the engine 1, detects an intake pressure PM, which reflects the load of the engine 1, and outputs a signal according to the detected value. The ignition switch 35 is operated to start and stop the engine 1. The vehicle speed sensor 36 detects a speed of the vehicle (vehicle speed) SPD, and outputs a signal according to the detected value. The intake air-temperature sensor 37 is provided to the intake passage inlet of the engine 1, detects an outside air temperature taken into the intake passage as an intake air-temperature THA, and outputs a signal according to the detected value. The heater switch 38 is operated in order to turn on/off the heater 12. In this embodiment, when the heater switch 38 is turned on, the shut-off valve 13 is opened in order to turn on the heater 12. Moreover, when the heater switch 38 is turned off, the ECU 30 closes the shut-off valve 13 in order to turn off the heater 12. The compartment temperature sensor 39 detects a compartment temperature THR of the vehicle, and outputs a signal according to the detected value.

In this embodiment, the ECU 30 executes the coolant temperature control. As is known well, the ECU 30 includes a central processing unit (CPU), a read-only memory (ROM), a random access memory (RAM), a backup RAM, an input interface circuit, and an output interface circuit. The ECU 30 constitutes an arithmetic logic circuit configured by connecting the CPU, the ROM, the RAM and the backup RAM with the input interface circuit, the output interface circuit or the like. The ROM stores therein in advance a predetermined control program concerning the coolant temperature control or the like. The RAN temporarily stores therein an arithmetic operation result of the CPU. The backup RAM saves the previously stored data. The CPU executes the coolant temperature control or the like in accordance with a predetermined control program based on detection signals from various kinds of sensors 31 to 39 input through the input circuit.

Figure 4:
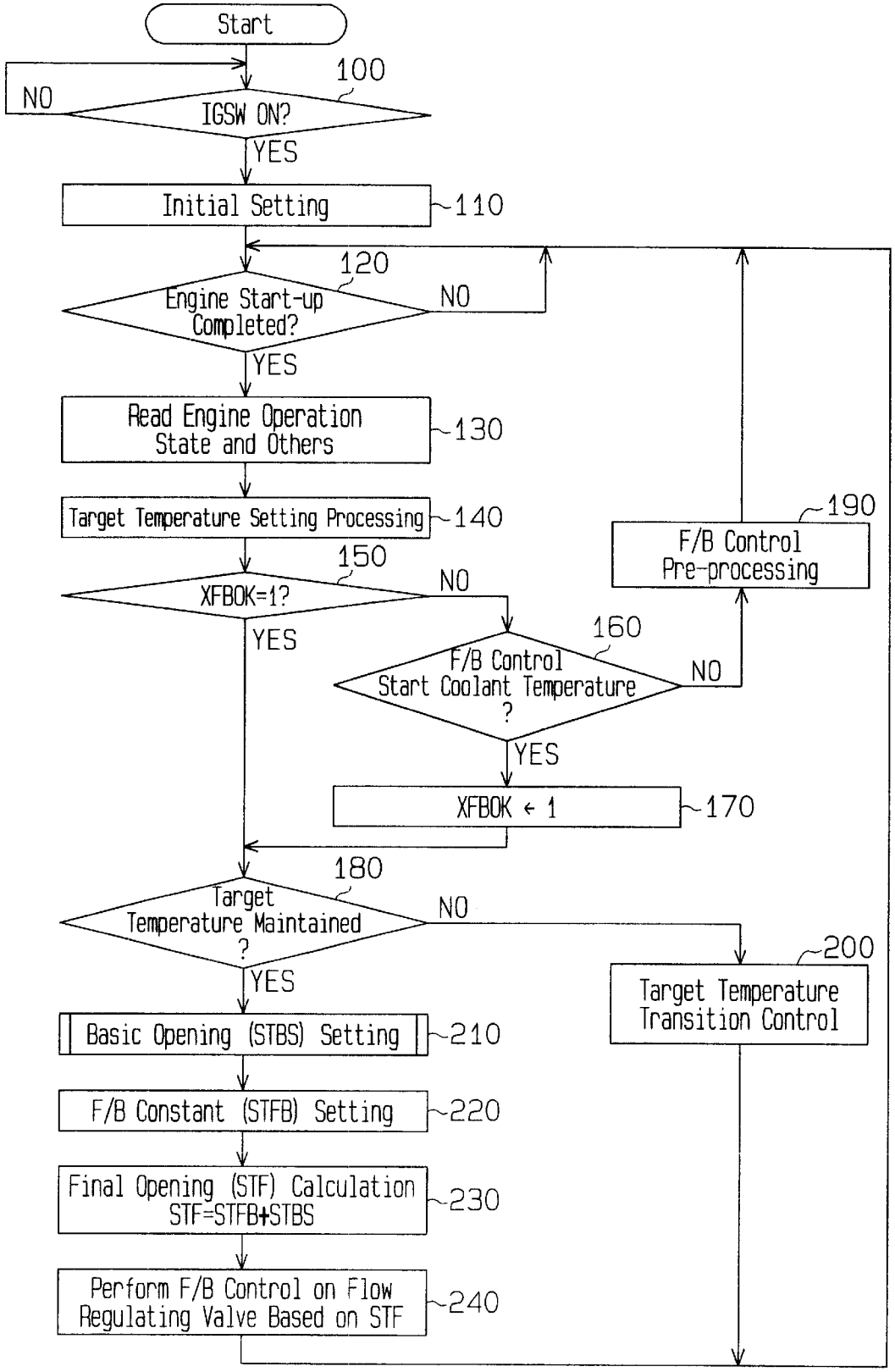
FIG. 4 is a flowchart showing a main routine of the coolant temperature control.

The content of the coolant temperature control executed by the ECU 30 will now be described with reference to FIGS. 4 to 10. FIG. 4 is a flowchart showing a main routine of the coolant temperature control.

In step 100, the ECU 30 waits until the ignition switch (IGSW) 35 is turned on. When this switch is turned on, the initial setting is executed in step 110. Here, the initial setting includes opening position confirmation processing (abutting control of the valve bodies 21 and 22) of the flow regulating valve 8, "initial opening setting processing" of the flow regulating valve 8, AD processing, data reset of the RAM.

An example of the "initial opening setting processing" will now be described with reference to the flowcharts of FIGS. 5 and 6. At first, in the routine shown in FIG. 5, the ECU 30 reads a value of the engine outlet coolant temperature THW1 detected by the first coolant temperature sensor 31 in step 111.

Then, in step 112, the ECU 30 judges whether a value of the read engine outlet coolant temperature THW1 is lower than a predetermined value th1. In this embodiment, as the predetermined value th1, "100±2° C." corresponding to a high temperature is used, for example.

In addition, if a result of judgment in step 112 is positive, the coolant temperature is yet to reach a high temperature, and hence the ECU 30 fully closes the flow regulating valve 8 in order to increase the coolant temperature in step 113.

On the contrary, if a result of judgment in step 112 is negative, the coolant temperature has already reached a high temperature, and hence the ECU 30 fully opens the flow regulating valve 8 in step 114 in order to suppress further increase in the coolant temperature.

Figure 5:
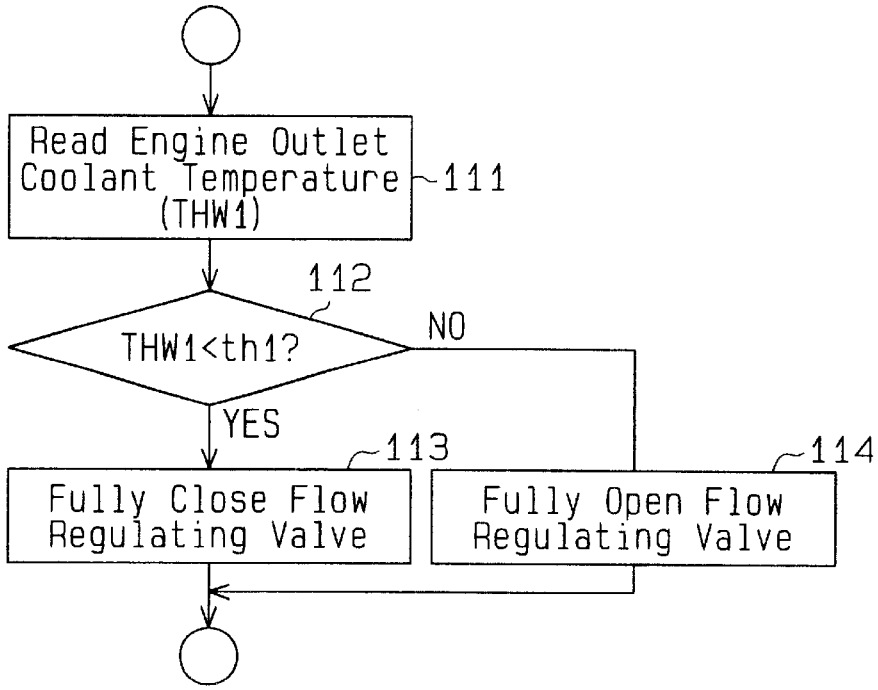
FIG. 5 is a flowchart showing a subroutine of the initial setting.

That is, in the routine shown in FIG. 5, when the ignition switch 35 operated to start the engine is turned on, the ECU 30 controls the flow regulating valve 8 in accordance with the engine outlet coolant temperature THW1 indicative of a temperature state of the engine 1 at that moment. Specifically, the ECU 30 controls the flow regulating valve 8 to be forcibly fully opened or closed in accordance with a value of the engine outlet coolant temperature THW1. To describe in detail, the ECU 30 controls the flow regulating valve 8 to be fully closed when a value of the engine outlet coolant temperature THW1 is less than a predetermined value th1, and controls the flow regulating value 8 to be fully opened when the engine outlet coolant temperature THW1 is not less than the predetermined value th1.

Figure 6:
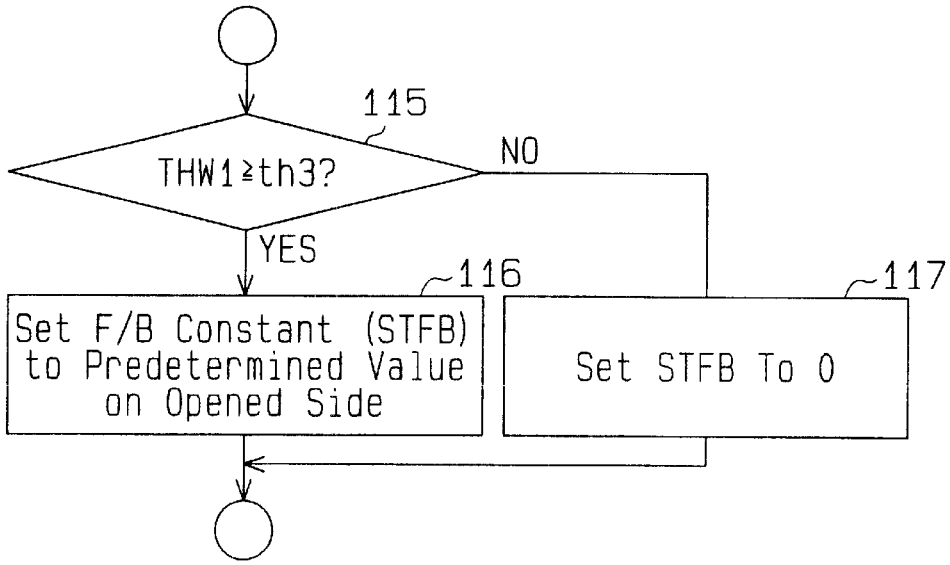
FIG. 6 is a flowchart showing a subroutine of the initial setting.

Then, the ECU 30 executes the routine shown in FIG. 6. In step 115, the ECU 30 first judges whether a value of the engine outlet coolant temperature THW1 read in step 111 in FIG. 5 is a predetermined value th3 or more.

If a result of this judgment is positive, the ECU 30 sets a value of an F/B constant STFB as a feedback term used in the later-descried feedback control to a predetermined value on the opened side in step 116. In this embodiment, as the F/B constant STFB, "50 steps" corresponding to the opening of "25%" is used, for example.

On the other hand, if a result of the judgment in step 115 is negative, the ECU 30 sets the F/B constant STFB to "0" in step 117.

That is, in the routine illustrated in FIG. 6, the ECU 30 variably sets the initial value of the F/B constant STFB corresponding to the feedback term for the feedback control in accordance with a value of the engine outlet coolant temperature THW1. To describe in detail, when a value of the engine outlet coolant temperature THW1 is not less than the predetermined value th3, a value of the F/B constant STFB is set to a relatively large value in such a manner that the flow regulating valve 8 has the opening on the opened side as compared with the case when the engine outlet coolant temperature THW1 is lower than the predetermined value th3.

Subsequently, again referring to the main routine of FIG. 4, the ECU 30 waits for determination on completion of startup of the engine 1 and advances the processing to step 130. In this embodiment, the ECU 30 judges completion of start-up based on detected values of the engine speed sensor 33 and the intake pressure sensor 34.

When start-up of the engine 1 is completed in step 120, the ECU 30 reads various kinds of values concerning the operation state of the engine 1 in step 130. In this embodiment, the ECU 30 reads values of the engine outlet coolant temperature THW1, the engine speed NE and the intake pressure PM detected by the first coolant temperature sensor 31, the engine speed sensor 33 and the intake pressure sensor 34.

Subsequently, in step 140, the ECU 30 executes target temperature setting processing. The target temperature setting processing is processing for setting a target temperature TMP according to the current operation state of the engine 1, and executed in accordance with a subroutine depicted in FIG. 7.

That is, in step 141, the ECU 30 calculates a value of the engine load based on values of the currently read engine speed NE and the intake pressure PM.

Then, in step 142, the ECU 30 judges whether the engine load is a high load above a predetermined value. If a result of this judgment is positive, the ECU 30 sets a relatively low temperature, e.g., "80° C." as a target temperature TMP in step 143. If a result of this judgment is negative, the ECU 30 advances the processing to step 144.

In step 144, the ECU 30 judges whether the engine load is a medium load based on whether the engine 1 is in the idle operation mode. If a result of this judgment is positive, the ECU 30 sets a relatively high temperature, e.g., "100° C." as a target temperature TMP in step 145. In case of the idle operation, namely, in the case where a result of judgment is negative, the ECU 30 sets a temperature lower than that in the partially loaded operation that the engine load is the medium load, e.g., "90° C." as a target temperature TMP. In this manner, the target temperature setting processing is terminated.

Figure 7:
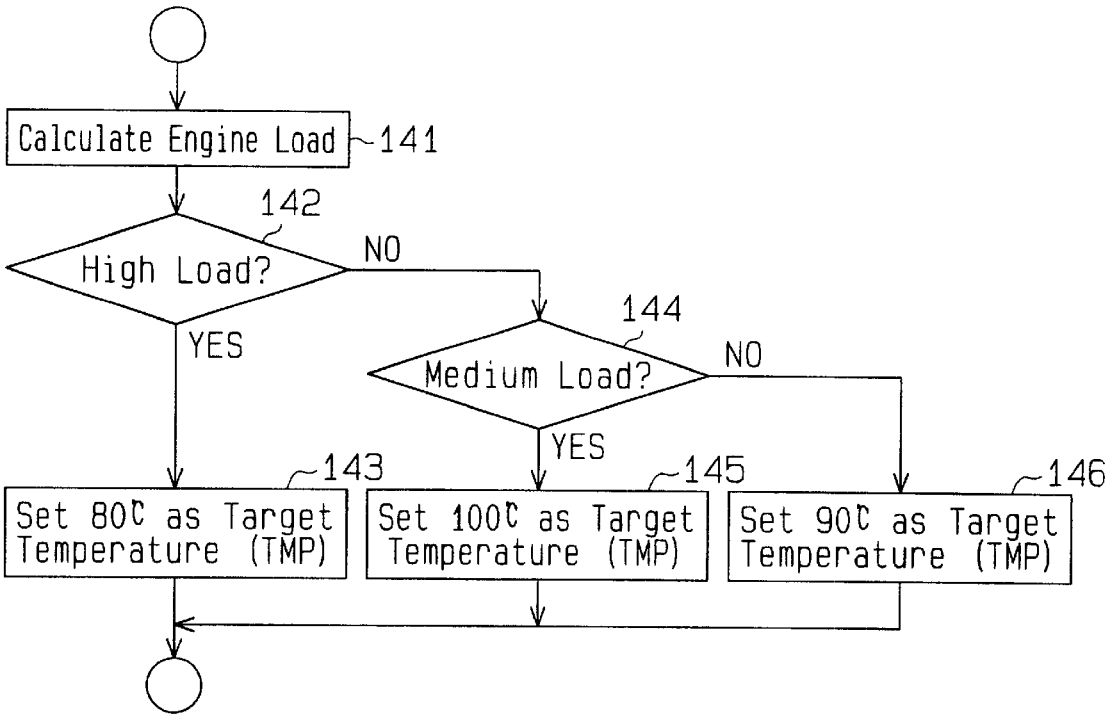
FIG. 7 is a flowchart showing a subroutine of the target temperature setting.

In the routine of FIG. 7, a value of the target temperature TMP is set based on the operation state of the engine 1. In particular, when the engine load is higher than a predetermined value, a value of the target temperature TMP is set relatively lower as compared with the case when the engine load is lower than the predetermined value. When the engine 1 is in the idle operation mode, a value of the target temperature TMP is set relatively lower as compared with the case when the engine 1 is in the partially loaded operation mode.

Then, again referring to the routine in FIG. 4, the ECU 30 judges whether a feedback (F/B) control allowance flag XFBOK is "1" in step 150. If a result of this judgment is positive, it is determined that the feedback control over the coolant temperature has been already accepted, and the ECU 30 advances the processing to step 180. If a result of this judgment is negative, the ECU 30 advances the processing to step 160.

In step 160, the ECU 30 judges whether a value of the currently read engine outlet coolant temperature THW1 has reached a feedback control start temperature. In this embodiment, for example, "100° C." is applied as the feedback control start temperature. If a result of this judgment is negative, since the feedback control can not be accepted, the ECU 30 advances the processing to step 190.

Figure 8:
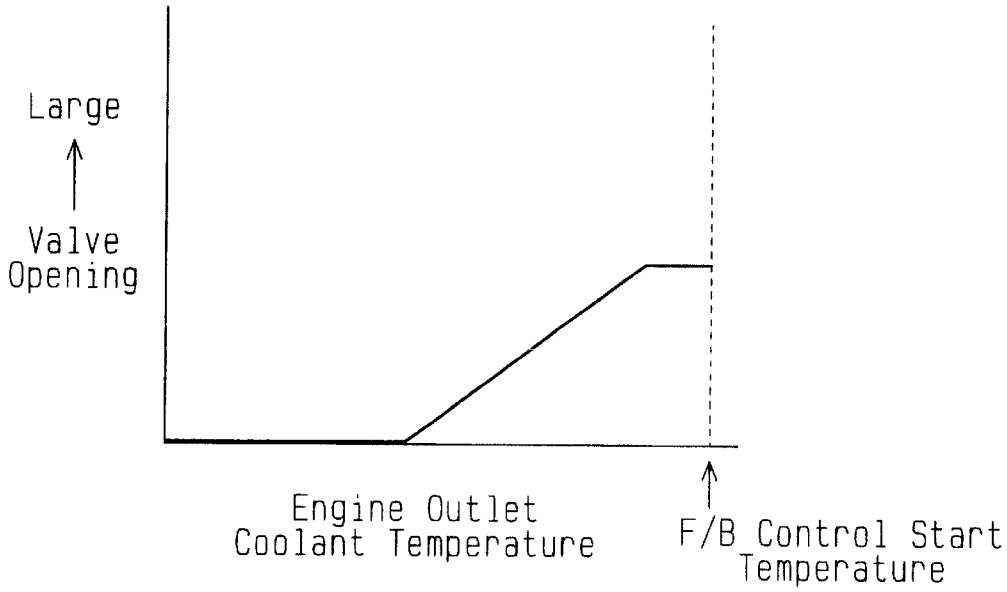
FIG. 8 is a graph showing the feedback control preprocessing.

In step 190, the ECU 30 executes the feedback (F/B) control pre-processing, and returns the processing to step 120. That is, the ECU 30 executes the feedback control preprocessing, and performs the open loop control so that the opening of the flow regulating valve 8 is set to a predetermined value. Here, in the feedback control preprocessing, warming-up of the engine 1 is facilitated by completely closing the flow adjusting valve 8 until the coolant temperature (engine outlet coolant temperature THW1) reaches a predetermined temperature set lower than the feedback control start temperature. Additionally, when the coolant temperature reaches a predetermined temperature, the opening of the flow regulating valve 8 is set close to an opening required in the feedback control, and the assured flow of the coolant is formed in the main piping 5 so that the second coolant temperature sensor 32 can detect an accurate coolant temperature. Therefore, as shown in FIG. 8, when the engine outlet coolant temperature THW1 reaches a predetermined temperature set lower than the feedback control start temperature, the ECU 30 gradually increases the opening of the flow regulating valve 8 from the fully closed state until the opening reaches the feedback control start opening in accordance with increase in the coolant temperature.

That is, when the coolant temperature of the engine 1 is lower than the feedback control start temperature, the ECU 30 prohibits updating of the F/B constant STFB as the later-described feedback term, and performs the open loop control to set the opening of the flow regulating valve 8 to a predetermined value. Further, the ECU 30 sets the opening of the flow regulating valve 8 at the start of the feedback control to a given value on the opened valve side by setting the predetermined value based on the coolant temperature of the engine 1.

On the other hand, when a result of judgment in step 160 is positive, the ECU 30 sets the feedback control allowance flag XFBOK to "1" in step 170 in order to allow the feedback control, and advances the processing to step 180.

Advancing from step 150 or step 170, the ECU 30 judges whether the target temperature is maintained in step 180. That is, it judges whether the currently set target temperature TMP is the same as the previous target temperature TMP. If a result of this judgment is negative, the ECU 30 executes the target temperature transition control in step 200 in order to change the target temperature TMP, and returns the processing to step 120.

On the other hand, if a result of the judgment in step 180 is positive, the ECU 30 sets a value of a basic opening STBS, which is a feedforward term in the present invention and corresponds to a prospective opening, in step 210. In this embodiment, the ECU 30 sets a value of the basic opening STBS in accordance with a subroutine shown in FIG. 9.

That is, in step 211, the ECU 30 judges whether the currently set target temperature TMP is "80° C.". If a result of this judgment is positive, the ECU 30 calculates a value of the basic opening STBS based on values of the currently read engine speed NE and intake pressure PM by making reference to a predetermined low-temperature map in step 212.

On the other hand, if a result of the judgment in step 211 is negative, the ECU 30 judges whether the currently set target temperature TMP is "90° C." in step 213. The ECU 30 calculates a value of the basic opening STBS based on values of the currently read engine speed NE and intake pressure PM by making reference to a predetermined medium-temperature map in step 214.

On the other hand, if a result of the judgment in step 213 is negative, the ECU 30 calculates a value of the basic opening STBS based on values of the currently read engine speed NE and intake pressure PM by making reference to a predetermined high-temperature map in step 215.

Here, the low-temperature map, the medium-temperature map and the high-temperature map are maps set with the prospective opening used for setting the engine outlet coolant temperature THW1 at the target temperature TMP to be determined as the basic opening STBS, and a value of the basic opening STBS is set in accordance with values of the engine speed NE and the intake pressure PM. That is, in the low-temperature map, the basic opening STBS used for setting a value of the engine outlet coolant temperature THW1 to "80° C." is set based on the engine speed NE and the intake pressure PM in advance. In the medium-temperature map, the basic opening STBS used for setting a value of the engine outlet coolant temperature THW1 to "90° C." is set based on the engine speed NE and the intake pressure PM in advance. In the high-temperature map, the basic opening STBS used for setting a value of the engine outlet coolant temperature THW1 to "100° C." is set based on the engine speed NE and the intake pressure PM in advance.

Figure 9:
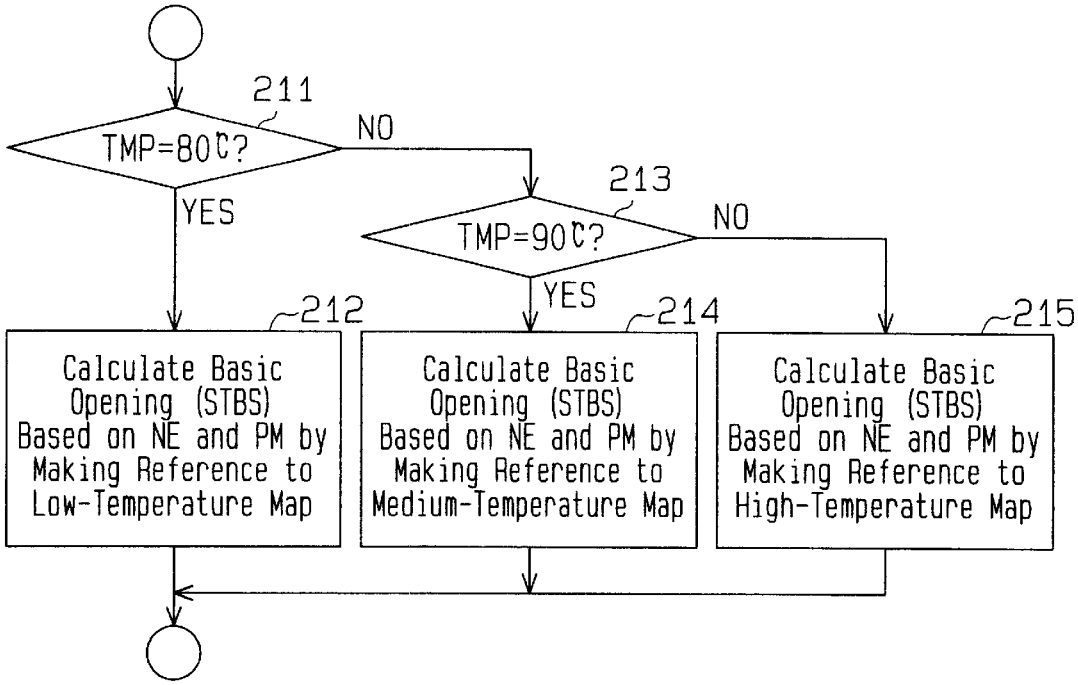
FIG. 9 is a flowchart showing a subroutine of the basic opening setting.

That is, in the subroutine shown in FIG. 9, the ECU 30 sets a value of the basic opening STBS as the feedforward term used together with the F/B constant STFB, which is the feedback term in the later-described feedback control, in accordance with the operation state of the engine 1. In this embodiment, a value of the basic opening STBS is stored in the memory of the ECU 30 as the low-temperature map, the medium-temperature map and the high-temperature map in accordance with a value of the target temperature TMP, and the ECU 30 sets a value of the basic opening STBS based on a value of the target temperature TMP.

Next, in step 220, the ECU 30 sets a value of the F/B constant STFB as the feedback term, which is increased or decreased in such a manner that a value of the engine outlet coolant temperature THW1 becomes a value of the target temperature TMP. That is, a value of the F/B constant STFB is set based on a temperature difference between a value of the engine outlet coolant temperature THW1 and a value of the target temperature TMP. Here, when the processing in this step 220 is carried out for the first time, a value of the F/B constant STFB obtained as an initial value in the initial setting in step 110 is applied.

Then, in step 230, the ECU 30 calculates the final opening STF in accordance with the following calculation expression (1):

$$STF=STFB+STBS \quad ((1)$$

Thereafter, in step 240, the ECU 30 performs the feedback control over the flow regulating valve 8 based on a value of the currently calculated final opening STF in such a manner that a value of the engine outlet coolant temperature THW1 becomes a value of the target temperature TMP.

According to the engine cooling apparatus of the embodiment described above, in operation of the engine 1, a flow rate of the coolant that passes through the radiator 7 is adjusted by controlling the opening of the flow regulating valve 8 by the ECU 30, and a value of the engine outlet coolant temperature THW1 is adjusted so as to become a value of the target temperature TMP, thereby adjusting the degree of cooling of the engine 1.

Here, a value of the basic opening STBS as the feedforward term is set based on the operation state of the engine 1, and a value of the F/B constant STFB as the feedback term, which is increased or decreased in such a manner that a value of the engine outlet coolant temperature THW1 becomes a value of the target temperature TMP, is set. Then, a value of the final opening STF is calculated based on values of the F/B constant STFB and the basic opening STBS, and the opening of the flow regulating valve 8 is subjected to the feedback control based on the calculated value. Therefore, the opening of the flow regulating valve 8 is immediately caused to approximate the prospective opening, which is determined based on a value of the basic opening STBS, and the engine outlet coolant temperature THW1 is adjusted to become the opening, which is a value of the target temperature TMP based on a value of the F/B constant STFB. As a result, it is possible to improve the accuracy of the coolant temperature control carried out in order to adjust a temperature of the coolant circulating in the engine 1 to the target temperature, thereby enhancing the responsibility of this control.

In particular, in this embodiment, even in the transient operation in which the engine 1 has a high load, a value of the target temperature TMP suitable for the high-loaded operation is set, and a value of the basic opening STBS appropriate for the value of the target temperature TMP is set in accordance with the operation state of the engine 1. Then, since the opening of the flow regulating valve 8 is immediately controlled with the value of the basic opening STBS being determined as the prospective opening, the coolant temperature starts to be rapidly adjusted to the value of the target temperature TMP. Therefore, the responsibility of the coolant temperature control can be improved in accordance with the transient operation in which the operation state of the engine 1 suddenly varies.

Figure 10:
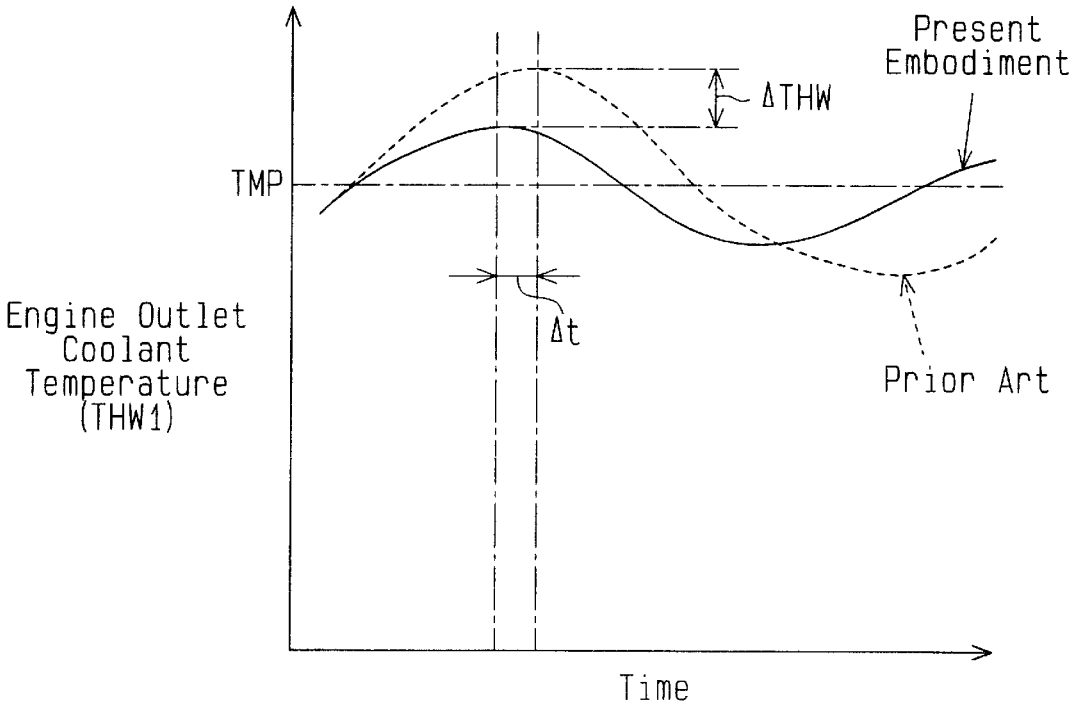
FIG. 10 is a time chart showing the behavior of the engine outlet coolant temperature.

FIG. 10 is a time chart showing the behavior of the engine outlet coolant temperature THW1 according to this embodiment in comparison with that in the prior art. As apparent from this time chart, in regard to the behavior (solid line) of the engine outlet coolant temperature THW1 according to this embodiment, it can be understood that the phase advances by only a predetermined time Δt with respect to the behavior in the prior art (broken line) and the amplitude is also small by only a predetermined temperature ΔTHW. That is, in the engine cooling apparatus according to this embodiment, it can be understood that the engine outlet coolant temperature THW1 rapidly converges on the target temperature TMP. Based on this, the engine 1 can be preferably cooled down even in the transient operation, and it is possible to achieve reduction in friction and improvement in fuel consumption and knocking performance.

In this embodiment, when the operation of the engine 1 is high-loaded, since the target temperature TMP of the coolant temperature is controlled to become a predetermined low temperature (for example, "80° C."), it is possible to effectively prevent the engine 1 from being overheated in the high-loaded operation in which an amount of heat generation from the engine 1 increases.

In this embodiment, when the operation of the engine 1 is medium-loaded, since the target temperature TMP of the coolant temperature is controlled to become a predetermined high temperature (for example, "100° C."), the friction of the engine 1 at this moment can be reduced, and fuel consumption can be improved.

In this embodiment, in the initial setting of the coolant temperature control, when the start operation of the engine 1 is detected, namely, when it is detected that the ignition switch 35 is turned on, the opening control of the flow regulating valve 8 is immediately started. Therefore, the opening of the flow regulating valve 8 is caused to approximate the opening required after the start-up until the start-up of the engine 1 is completed. Thus, after the startup of the engine 1, the opening of the flow regulating valve 8 can be caused to rapidly approximate the final opening STF by the feedback control, thereby improving the convergence and the responsibility of the coolant temperature relative to the target temperature TMP.

In particular, in this embodiment, when the engine outlet coolant temperature THW1 is not less than a predetermined value th1, the opening of the flow regulating valve 8 is hence controlled on the opened side and a flow rate of the coolant that passes through the radiator 7 is increased until the start-up of the engine 1 is completed. Therefore, for example, in the high-temperature start-up of the engine 1, an amount of heat radiated from the radiator 7 can be increased, and cooling of the engine 1 can be facilitated, thereby preventing the engine 1 from being overheated. To described in detail, in this embodiment, when the engine outlet coolant temperature THW1 is not less than a predetermined value th1, the flow regulating valve 8 is hence controlled to be fully opened and a flow rate of the coolant that passes through the radiator 7 is increased to a maximum level until the start-up of the engine 1 is completed. Accordingly, an amount of heat radiated from the radiator 7 can be increased to a maximum level, and cooling of the engine 1 can be carried out at the maximum level, thereby rapidly preventing the engine 1 from being overheated.

On the other hand, in this embodiment, when the engine outlet coolant temperature THW1 is less than a predetermined value th1, the opening of the flow regulating valve 8 is controlled to the closed side and a flow rate of the coolant that passes through the radiator 7 is decreased until the start-up of the engine 1 is completed in accordance with this coolant temperature. Therefore, for example, in the cold start-up of the engine 1, an amount of heat taken from the engine 1 to the coolant can be reduced, warming-up of the engine 1 can be facilitated, the engine 1 can be prevented from being overcooled, and the fuel consumption of the engine 1 can be improved. To describe in detail, in this embodiment, when the engine outlet coolant temperature THW1 is less than a predetermined value th1, the opening of the flow regulating valve 8 is controlled to be fully closed and a flow of the coolant that passes through the radiator 7 is shut off until the start-up of the engine 1 is completed in accordance with this temperature. Therefore, an amount of heat taken from the engine 1 to the coolant can be reduced to a maximum level, and warming-up of the engine 1 can be carried out at the maximum level. Also, the engine 1 can be rapidly prevented from being overcooled, and the fuel consumption of the engine 1 can be improved to the maximum level.

In this embodiment, the initial value of the F/B constant STFB as the feedback term is variably set by the ECU 30 based on the temperature state of the engine 1 when the engine 1 is started up, namely, a value of the engine outlet coolant temperature THW1. Therefore, since the initial value of the F/B constant STFB is set to a value according to the temperature state of the engine 1 when the engine 1 is started up, the feedback control of the flow regulating valve 8 can be started from the opening according to the temperature state of the engine 1 after the start-up of the engine 1. Therefore, after the start-up of the engine 1, a flow rate of the coolant suitable for the temperature state of the engine 1 can be rapidly obtained in the coolant circulation passage, thereby improving the responsibility of the coolant temperature control.

In particular, in this embodiment, when the engine outlet coolant temperature THW1 when the engine 1 is started up is higher than a predetermined value th3, the F/B constant STFB is set to the initial value on the opened side in accordance with the coolant temperature, and hence the feedback control of the flow regulating valve 8 can be started from the opening on the opened side capable of increasing a flow rate of the coolant that passes through the radiator 7 in accordance with the high-temperature state. Thus, the engine 1 can be prevented from being overheated at the time of high-temperature start-up of the engine 1.

In this embodiment, a value of the target temperature TMP is variably set based on the operation state of the engine 1 after the start-up of the engine 1. To describe in detail, when the load of the engine 1 is a high load higher than a predetermined value, a value of the target temperature TMP is set to "80° C.", which is relatively lower than that in case of the medium load and the low load. Further, the target temperature TMP is set to "90° C." when the engine 1 is in the idle operation mode, and the target temperature TMP is set to "100° C." in the partially loaded operation mode of the medium load. As a result, in the idle operation mode, the target temperature TMP is set relatively lower than that in case of the partially loaded operation mode.

Therefore, when performing the feedback control over the flow regulating valve 8, the engine outlet coolant temperature THW1 is caused to approximate a value of the target temperature TMP suitable for the operation mode of the engine 1 and the loaded state in particular. That is, when the engine 1 is high-loaded, the engine outlet coolant temperature THW1 is caused to approximate a value of the target temperature TMP, which is oriented to increase the cooling capability and relatively low, in accordance with the load. Therefore, it is possible to rapidly demonstrate the effective cooling capability in accordance with the operation state of the engine 1. That is, when the engine 1 is high-loaded, the engine 1 can be effectively cooled down and overheating can be avoided. On the other hand, when the engine 1 is in the idle operation mode, the engine outlet coolant temperature THW1 is caused to approximate the target temperature TMP, which is relatively lower than that in case of the partially loaded operation mode, in accordance with the idle operation. Based on this, when starting the vehicle from the idle operation, knocking of the engine 1 can be effectively prevented. Although it is desirable to set the target temperature TMP to a relatively high value (for example, "100° C." equal to that of the medium load) in order to reduce the friction of the engine 1, knocking is apt to occur when starting the vehicle from the idle operation if the target temperature TMP is set to a high value until the idle operation. Thus, in this embodiment, in order to prevent knocking at the time of start, the target temperature TMP in the idle operation mode is set to "90° C.", which is lower than that in the partially loaded operation mode by "10° C.".

In this embodiment, the values of the basic opening STBS according to values of the operation state of the engine 1, i.e., the engine speed NE and the intake pressure PM are respectively associated with the target temperature TMP of 80° C., the target temperature TMP of 90° C. and the target temperature TMP of 100° C., and they are stored in the memory of the ECU 30 in the form of a low-temperature map, a medium-temperature map and a high-temperature map in advance. Furthermore, the values of the basic opening STBS are set based on the respective values of the target temperature TMP. Here, since the cooling loss of the engine 1 is also changed when the value of the target temperature TMP varies, the basic opening STBS, which is a prospective opening of the flow regulating valve 8, must be changed in order to vary a flow rate of the coolant in accordance with the target temperature. Here, the prospective opening of the flow regulating valve 8 is determined in accordance with the value of the target temperature TMP based on the values of the basic opening STBS stored in the memory as the different maps in accordance with the respective values of the target temperature TMP. Therefore, even if the value of the target temperature TMP is changed when performing the feedback control of the flow regulating valve 8, the prospective opening is variably set in accordance with this value. Therefore, a flow rate of the coolant can be changed to an appropriate amount, thereby improving the responsibility of the coolant temperature of the engine 1 with respect to the target temperature TMP.

In this embodiment, when the engine outlet coolant temperature THW1 is lower than the feedback control start temperature, updating of the value of the F/B constant STFB is prohibited, the opening of the flow regulating valve 8 is subjected to the open loop control to be a predetermined value by the feedback control pre-processing. That is, at that moment, the opening of the flow regulating valve 8 can be forcibly completely closed, and warming-up of the engine 1 can be facilitated before the feedback control. Moreover, as shown in FIG. 8, when the engine outlet coolant temperature THW1 reaches a predetermined temperature, which is set lower than the feedback control start temperature, the opening of the flow regulating valve 8 is gradually increased from the fully closed state until the feedback control start temperature is reached with increase in the engine outlet coolant temperature THW1. Therefore, the opening of the flow regulating valve 8 can be caused to approximate the opening required in the feedback control before the feedback control, thereby improving the responsibility of the coolant temperature control when the feedback control is started. In addition, since an assured flow of the coolant can be formed in the main piping 5 and an accurate coolant temperature can be detected by the second coolant temperature sensor 32, the accurate radiator outlet coolant temperature THW2 can be detected even if the feedback control is started when the radiator outlet coolant temperature THW2 is used in the coolant temperature control, thereby improving the control accuracy of the coolant temperature control.

A second embodiment embodying the engine cooling apparatus according to the present invention will now be described in detail with reference to the accompanying drawings.

In each of the following embodiments, like reference numerals denote structures equal to those in the first embodiment, and a description will be given below mainly on different points.

Figure 11:
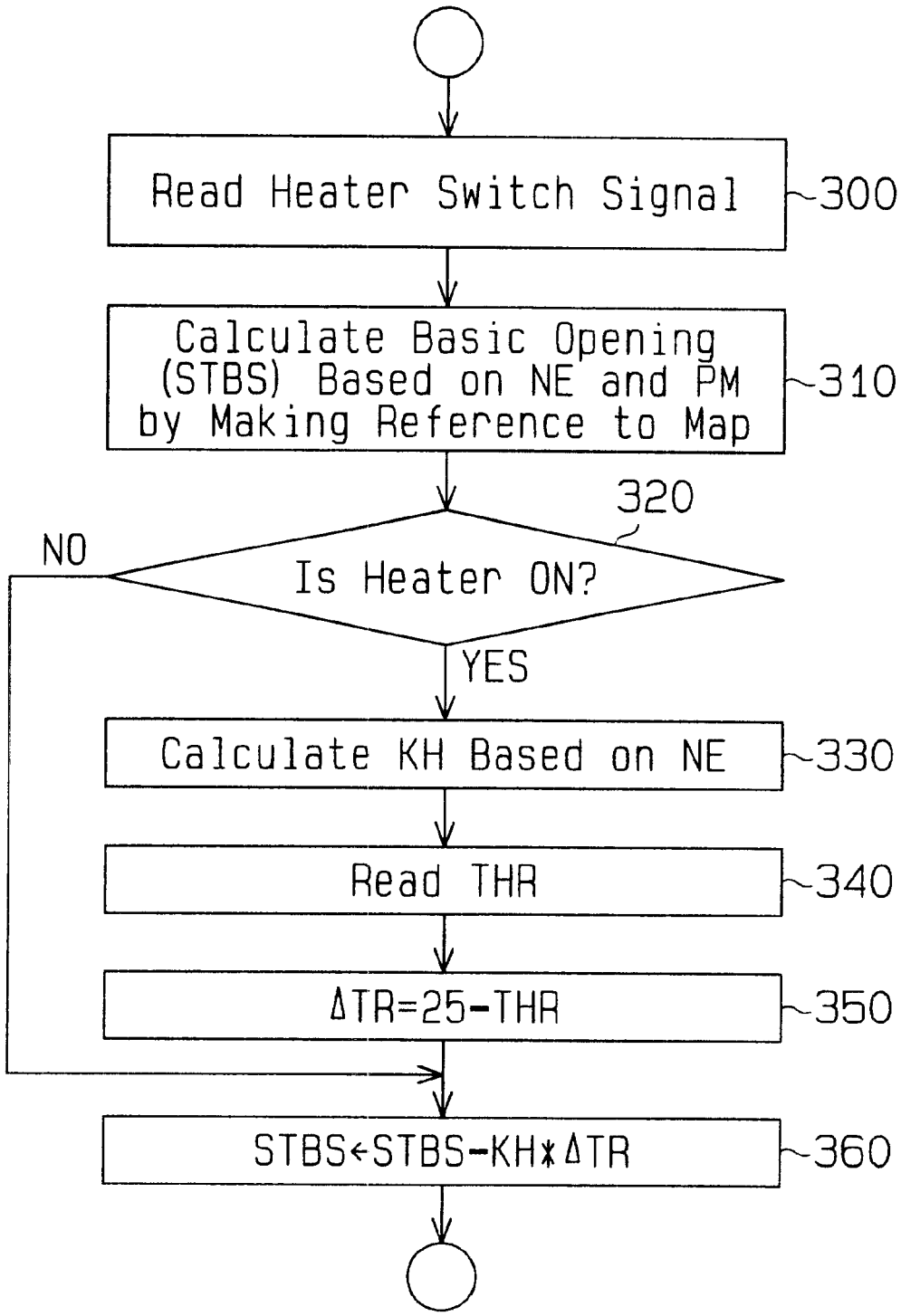
FIG. 11 is a flowchart showing a subroutine of the basic opening setting according to a second embodiment of the present invention.

The structure of this embodiment is different from that of the first embodiment in the content of processing in step 210 in the main routine illustrated in FIG. 4. Here, when the heater 12 is turned on during the regular travel of the vehicle, heat is transferred between the heater 12 and the coolant, and there may possibly occur a discordance between the basic opening STBS of the flow regulating valve 8 and the control temperature of the coolant according to this basic opening STBS. Thus, in this embodiment, necessary correction is applied to the basic opening STBS when the heater 12 is turned on. FIG. 11 is a flowchart showing the detailed content of processing.

In step 300, the ECU 30 first reads on/off signals from the heater switch 38.

Then, in step 310, the ECU 30 calculates a value of the basic opening STBS based on values of the currently read engine speed NE and the intake pressure PM by making reference to the basic opening map. The content of calculating the basic opening STBS may be the same as the content of calculation in the first embodiment.

Subsequently, in step 320, the ECU 30 judges whether the heater 12 is turned on. This judgment is carried out based on the on/off signals from the heater switch 38. If a result of this judgment is negative, the heater 12 is in the off state, and hence the ECU 30 advances the processing to step 360 without any alterations. If a result of this judgment is positive, since the heater 12 is in the on state, the ECU 30 advances the processing to step 330.

In step 330, the ECU 30 calculates a value of step number conversion coefficient KH based on a value of the currently read engine speed NE. This conversion efficient KH is used to convert an amount of heat radiated from the heater 12 in accordance with a difference in the engine speed NE into a step number for controlling the step motor 23 of the flow regulating valve 8 when the compartment temperature THR is, e.g., "25° C.". The ECU 30 calculates the conversion coefficient KH by making reference to a preset conversion coefficient map in connection with the engine speed NE. In the conversion coefficient map, the conversion coefficient KH is set to be smaller as the engine speed NE increases.

Then, the ECU 30 reads a value of the compartment temperature THR detected by the compartment temperature sensor 39 in step 340, and calculates a value of a temperature difference ΔTR of the compartment temperature THR with respect to "25° C.".

Additionally, when the processing is directly advanced from step 320 to step 360, the ECU 30 sets a value of the basic opening STBS calculated in step 310 without correction. However, when the processing is advanced from step 350 to step 360, the ECU 30 corrects a value of the basic opening STBS in step 360. In this embodiment, a value of the basic opening STBS is corrected by reducing a value obtained by multiplying the conversion coefficient KH by the temperature difference ΔTR from the basic opening STBS.

The thus corrected value of the basic opening STBS is used for calculating the final opening STF in step 230 in the flowchart of FIG. 4.

According to the engine cooling apparatus of the embodiment described above, a value of the basic opening STBS as the feedforward term is set based on the operation state (on/off) of the heater 12, which uses an amount of heat of the engine 1. To describe in detail, when the heater 12 is turned on, the basic opening STBS is corrected and set in such a manner that the opening of the flow regulating valve 8 is on the closed side as compared with the case when the heater 12 is turned off. Further, when the heater 12 is turned on, the basic opening STBS is corrected and set by subtracting a product of the conversion coefficient KH determined by the engine speed NE and the temperature difference ΔTR of the compartment temperature THR relative to "25° C." from the basic opening STBS. Here, by setting the conversion coefficient KH, the basic opening STBS is corrected and set in such a manner that the opening of the flow regulating valve 8 is on the closed side as the engine speed NE becomes lower.

Therefore, the opening of the flow regulating valve 8 is caused to approximate the prospective opening according to the operation state of the heater 12 based on a value of the basic opening STBS. Thus, the coolant temperature control can be carried out in accordance with the operation state of the heater 12, and the coolant temperature of the engine 1 can be appropriately adjusted to the target temperature TMP irrespective of on/off states of the heater 12. To describe in detail, when the heater 12 is turned on and an amount of heat of the engine 1 is consumed, the opening of the flow regulating valve 8 is caused to approximate the prospective opening on the closed side, which suppresses heat radiation from the radiator 7, based on the corrected value of the basic opening STBS. Therefore, the coolant temperature control can be appropriately carried out irrespective of the on/off states of the heater 12, and the coolant temperature of the engine 1 can be adequately adjusted to the target temperature TMP. To describe in detail, when the heater 12 is turned on and an amount of heat of the engine 1 is consumed, the opening of the flow regulating valve 8 is caused to further approximate the prospective opening on the closed side especially in the low rotation mode, which reduces an amount of heat generation, based on the corrected value of the basic opening STBS. Therefore, the coolant temperature control can be appropriately carried out irrespective of the on/off states of the heater 12 and a difference in the engine speed NE, and the degree of cooling the engine 1 can be adequately adjusted.

A third embodiment embodying the engine cooling apparatus according to the present invention will now be described in detail with reference to the accompanying drawings.

Figure 12:
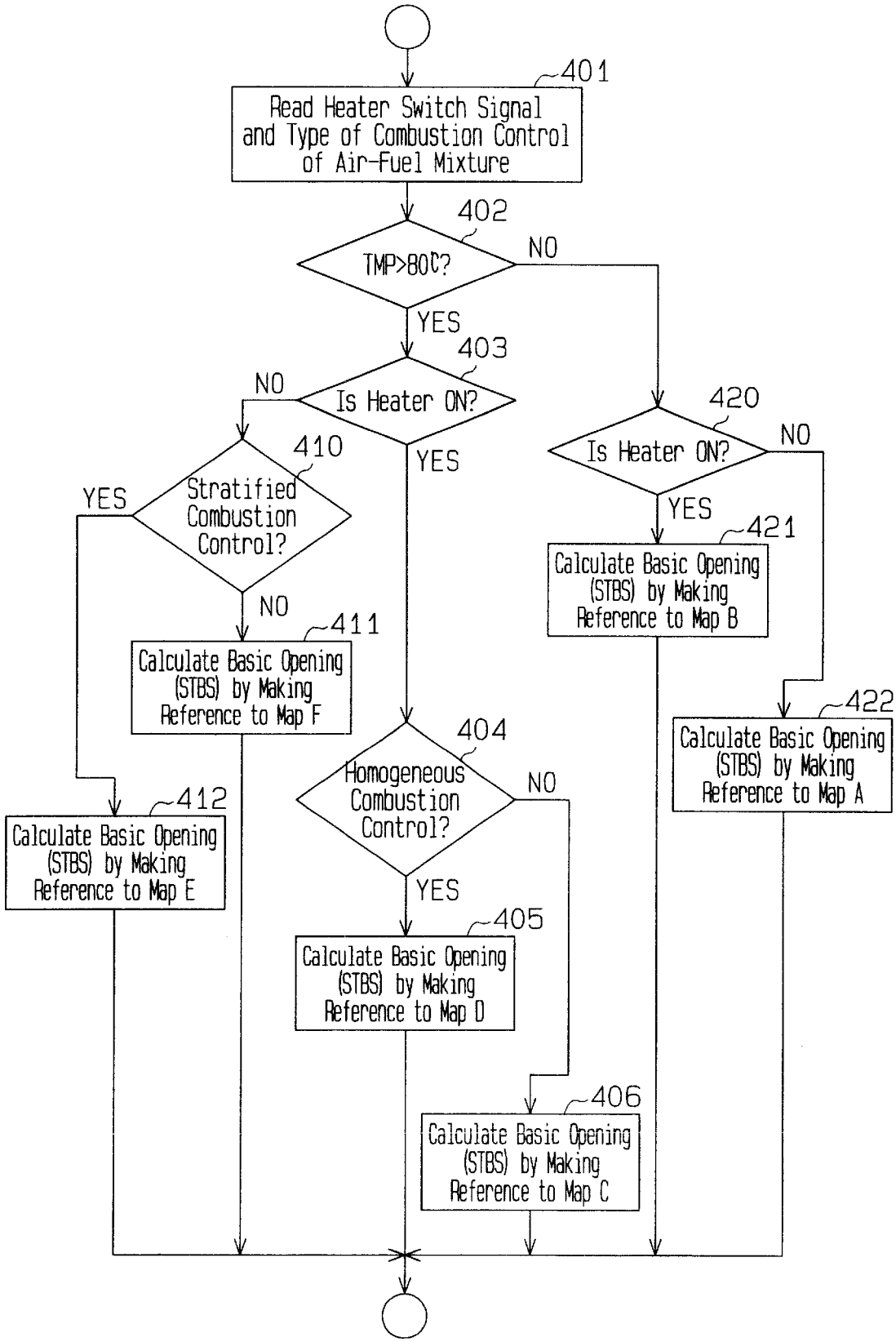
FIG. 12 is a flowchart showing a subroutine of the basic opening setting according to a third embodiment of the present invention.

The structure of this embodiment is different from that of the first embodiment in the content of processing in step 210 in the main routine illustrated in FIG. 4, namely, the method for setting the basic opening STBS. This content will now be described hereinafter in connection with the subroutine illustrated in FIG. 12.

In step 401, the ECU 30 first reads on/off signals of the heater switch 38 and a type of the combustion control of the air-fuel mixture in the engine 1. In this embodiment, as the combustion conformation of the engine 1, homogeneous combustion and stratified combustion can be switched. That is, at the time of warming-up of the engine 1, there is executed the homogeneous combustion control, which performs combustion in the homogeneous state in which the air-fuel mixture is homogeneously dispersed in the combustion chamber. Further, after the warming-up of the engine 1, there is executed the stratified combustion control, which carries out combustion in the stratified state in which the air-fuel mixture is collected around an ignition plug, in addition to the homogeneous combustion control, and these combustion controls are switched based on the operation state of the engine 1. Therefore, in this embodiment, for example, a flag used for setting changeover of the combustion control is read in order to judge which combustion control of the air-fuel mixture is currently carried out.

Then, in step 402, the ECU 30 judges whether the currently set target temperature TMP is greater than "80° C.". If a result of this judgment is positive, it is determined that the operation state of the engine 1 is in the mode after the warming-up, and the ECU 30 advances the processing to step 403.

In step 403, the ECU 30 judges whether the heater 12 is turned on based on a signal from the heater switch 38. If a result of this judgment is positive, it is determined that the coolant temperature is lowered owing to heat radiation from the heater 12, and the ECU 30 advances the processing to step 404 .

Furthermore, in step 404, the ECU 30 judges whether the combustion control is the homogeneous combustion control. If a result of this judgment is positive, the ECU 30 calculates a value of the basic opening STBS based on values of the currently read engine speed NE and intake pressure PM by making reference to a map D. In this map D, the value of the basic opening STBS is previously set based on the relationship between the engine speed NE and the engine load. It is previously set that the basic opening STBS becomes large as the engine speed NE increases and the basic opening STBS becomes large as the engine load increases even if the value of the engine speed NE remains unchanged.

If a result of the judgment in step 404 is negative, it is determined that the combustion control is based on the stratified combustion, and the ECU 30 calculates a value of the basic opening STBS based on values of the currently read engine speed NE and intake pressure PM by making reference to a map C in step 406. Although this map C is set by the structure similar to that of the map D, the value of the basic opening STBS is rather set to a value on the closed side than the map D as a whole since the homogeneous combustion is not used.

On the other hand, if a result of the judgment is negative in step 403, it is determined that the coolant temperature is not lowered by heat generation from the heater 12, and the ECU 30 advances the processing to step 410.

Then, in step 410, the ECU 30 judges whether stratified combustion control is performed. If a result of this judgment is negative, the ECU 30 calculates a value of the basic opening STBS based on values of the currently read engine speed NE and intake pressure PM by making reference to a map F. Although this map is set by the structure similar to that of the map D, the value of the basic opening STBS is rather set to a value on the opened side than the map D as a whole since the heater 12 is not turned on.

If a result of this judgment in step 410 is positive, the ECU 30 calculates a value of the basic opening STBS based on values of the read engine speed NE and the intake pressure PM by making reference to a map E. Although this map E is set by the structure similar to that of the map C, the value of the basic opening STBS is rather set to a value on the opened side than the map C as a whole since the heater 12 is not turned on.

On the other hand, if a result of the judgment in step 402 is negative, it is determined that the operation state of the engine 1 is the warming-up and the homogeneous combustion control is carried out, and the ECU 30 advances the processing to step 420.

Then, in step 420, the ECU 30 judges whether the heater 12 is turned on based on a signal from the heater switch 38. If a result of this judgment is positive, it is determined that the coolant temperature lowers owing to heat radiation from the heater 12, and the ECU 30 advances the processing to step 421.

In step 421, the ECU 30 calculates a value of the basic opening STBS based on values of the currently read engine speed NE and the intake pressure PM by making reference to the map B.

If a result of the judgment in step 420 is negative, it is determined that the coolant temperature is not lowered owing to heat radiation from the heater 12, and the ECU 30 calculates a value of the basic opening STBS based on values of the currently read engine speed NE and intake pressure PM by making reference to a map A. Although this map A is set by the structure similar to that of the map B, the value of the basic opening STBS is rather set to a value on the opened side than the map B as a whole since the heater 12 is not turned on.

The thus calculated value of the basic opening STBS is used for calculation of the final opening STF in step 230 in the flowchart of FIG. 4.

According to the engine cooling apparatus of this embodiment described above, data having the basic opening STBS set based on the relationship between the engine speed NE and the engine load is provided as a plurality of the maps A to F in accordance with the on/off states of the heater 12 and a difference in the combustion conformation of the engine 1, and the basic opening STBS is calculated by selectively making reference to these maps A to F. Therefore, when performing the feedback control of the flow regulating valve 8, the value of the basic opening STBS used as the feedforward term is set in accordance with the on/off states of the heater 12 and a difference in the combustion conformation of the engine 1 as well as a difference in the operation state of the engine 1.

In particular, in this embodiment, since the value of the basic opening STBS is set based on a variation of the combustion conformation of the engine 1, the opening of the flow regulating valve 8 is caused to approximate the prospective opening according to a difference in an amount of heat generation based on the setting of the basic opening STBS even if an amount of heat generation of the engine 1 varies depending on the combustion conformation. Therefore, the coolant temperature control can be adequately performed irrespective of a variation of the combustion conformation of the engine 1, and the coolant temperature of the engine 1 can be appropriately adjusted to the target temperature TMP.

To describe in detail, in this embodiment, since the value of the basic opening STBS is set in such a manner that the opening of the flow regulating valve 8 is set on the closed side as compared with the case of the homogeneous combustion when the combustion conformation is the stratified combustion, the opening of the flow regulating valve 8 is caused to further approximate the prospective opening on the closed side so as to suppress heat radiation from the radiator 7 by the setting of the basic opening STBS even if an amount of heat generation of the engine 1 is smaller than that in the homogeneous combustion. Thus, the coolant temperature control can be appropriately performed irrespective of the stratified combustion/homogeneous combustion, and the coolant temperature of the engine 1 can be adequately adjusted to the target temperature TMP.

Next, a fourth embodiment embodying the engine cooling apparatus according to the present invention will now be described in detail with reference to the accompanying drawings.

Figure 13:
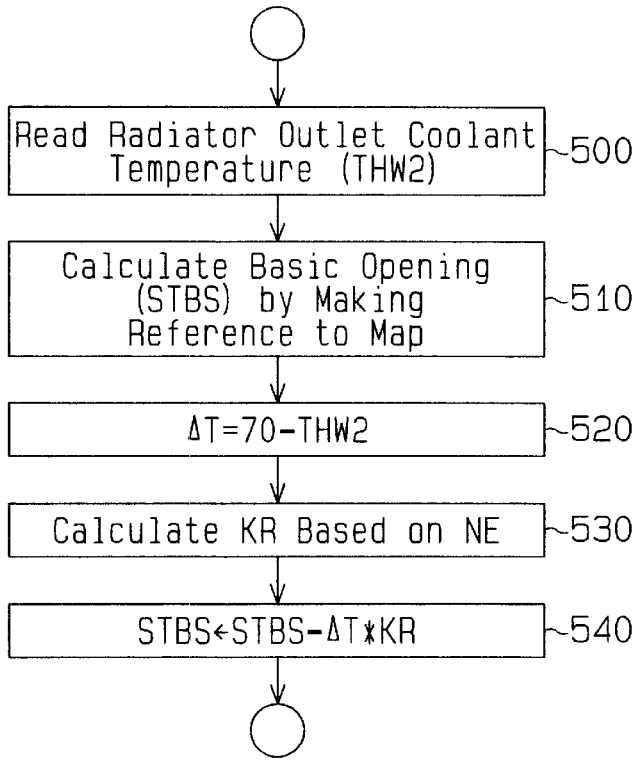
FIG. 13 is a flowchart showing a subroutine of the basic opening setting according to a fourth embodiment of the present invention.

The structure of this embodiment is different from the structures of the first to third embodiments in the processing content in step 210 in the main routine illustrated in FIG. 4. In this engine cooling apparatus, the coolant from the bypass piping 10 and the coolant from the main piping 5 through the radiator 7 are mixed by the flow regulating valve 8, and the mixed coolant is caused to flow to the engine 1 through the water pump 9. Therefore, a temperature of the coolant flowing to the engine 1 or the engine outlet coolant temperature THW1 depends on a temperature difference between a coolant temperature in the bypass piping 10 and a coolant temperature in the main piping 5 on the downstream side away from the radiator 7, and this temperature difference reflects the cooling state of the coolant by the radiator 7. As the engine speed NE increases due to this temperature difference, the engine outlet coolant temperature THW1 tends to deviate from the target temperature TMP. Thus, in this embodiment, correction required for the basic opening STBS is conducted based on the cooling state of the coolant by the radiator 7 and the engine speed NE. This processing content will now be described hereinafter with reference to the subroutine shown in FIG. 13.

In step 500, the ECU 30 first reads a value of the radiator outlet coolant temperature THW2 detected by the second coolant temperature sensor 32.

Subsequently, in step 510, the ECU 30 calculates a value of the basic opening STBS based on values of the currently read engine speed NE and intake pressure PM by making reference to a basic opening map. In this basic opening map, the basic opening STBS when the radiator outlet coolant temperature THW2 is, e.g., "70° C." is set based on the relationship with the engine speed NE and the engine load in advance.

Then, in step 520, the ECU 30 calculates a value of the coolant temperature difference ΔT of the radiator outlet coolant temperature THW2 with respect to "70° C.". The value of the coolant temperature difference ΔT reflects the cooling state of the coolant by the radiator 7.

Thereafter, in step 530, a value of a rotation correction coefficient KR relative to the value of the currently read engine speed NE is calculated by making reference to a predetermined coefficient map. In this coefficient map, the rotation correction coefficient KR is previously set to be smaller as the engine speed NE increases.

Then, in step 540, the ECU 30 corrects the calculated basic opening STBS based on the value of the coolant temperature difference ΔT and the value of the rotation correction coefficient KR in accordance with the following calculation expression (2):

$$STBS \leftarrow STBS - \Delta T * KR \quad (2)$$

The thus corrected value of the basic opening STBS is used for calculation of the final opening STF in step 230 in the flowchart of FIG. 4.

According to the engine cooling apparatus of this embodiment described above, the basic opening STBS is corrected based on the cooling state of the coolant by the radiator 7 and the engine speed NE, and the corrected basic opening STBS is used for the feedback control of the flow regulating valve 8. Here, although an amount of heat radiation of the coolant in the radiator 7, i.e., the cooling state of the coolant by the radiator 7 differs depending on the engine outlet coolant temperature THW1 or the engine speed NE, the basic opening STBS is corrected based on the coolant temperature difference ΔT reflecting the cooling state obtained from the radiator outlet coolant temperature THW2 and the rotation correction coefficient KR obtained from the engine speed NE, and the corrected basic opening STBS is set. That is, the corrected basic opening STBS is set based on the cooling state of the coolant by the radiator 7. To describe in detail, when the radiator outlet coolant temperature THW2 is lower than "70° C.", the corrected value of the basic opening STBS is set in such a manner that the opening of the flow regulating valve 8 is rather set on the closed side as compared with the case when the radiator outlet coolant temperature THW2 is higher than "70° C.".

Therefore, the opening of the flow regulating valve 8 is caused to approximate the prospective opening according to the cooling state of the coolant by the radiator 7 by the setting of the corrected basic opening STBS. To describe in detail, when the value of the radiator outlet coolant temperature THW2 is lower than "70° C.", the opening of the flow regulating valve 8 is caused to approximate the prospective opening on the closed side so as to suppress heat radiation from the radiator 7 by the setting of the corrected basic opening STBS. Therefore, the coolant temperature control can be adequately performed in accordance with the cooling state of the coolant by the radiator 7 irrespective of a difference in the radiator outlet coolant temperature THW2 in particular, and the coolant temperature of the engine 1 can be appropriately adjusted to the target temperature TMP.

Next, a fifth embodiment embodying the engine cooling apparatus according to the present invention will now be described in detail with reference to the accompanying drawings.

Likewise, the structure of this embodiment is different from the structures of the first to fourth embodiments in the processing content in step 210 in the main routine shown in FIG. 4. Here, as similar to the fourth embodiment, correction required for the basic opening STBS is carried out based on the cooling state of the coolant by the radiator 7 and the engine speed NE. That content will now be described in connection with the subroutine illustrated in FIGS. 14 to 16.

Figure 14:
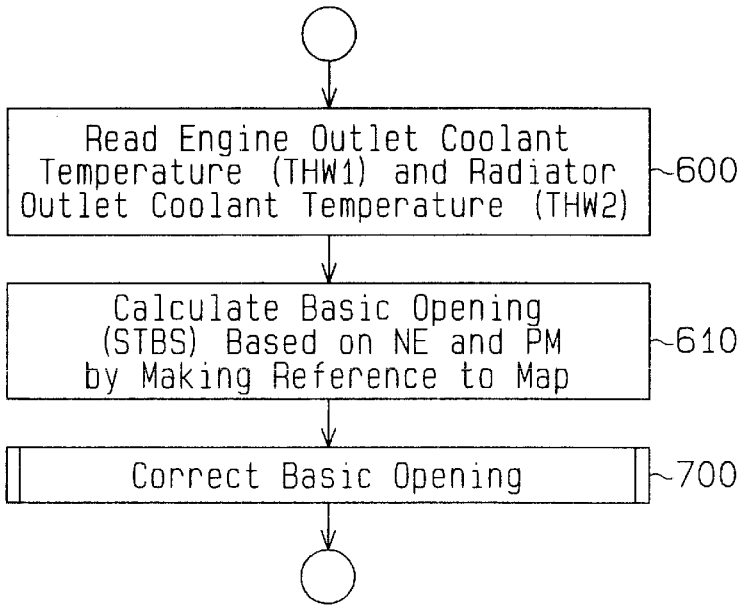
FIG. 14 is a flowchart showing a subroutine of the basic opening setting according to a fifth embodiment of the present invention.
Figure 15:
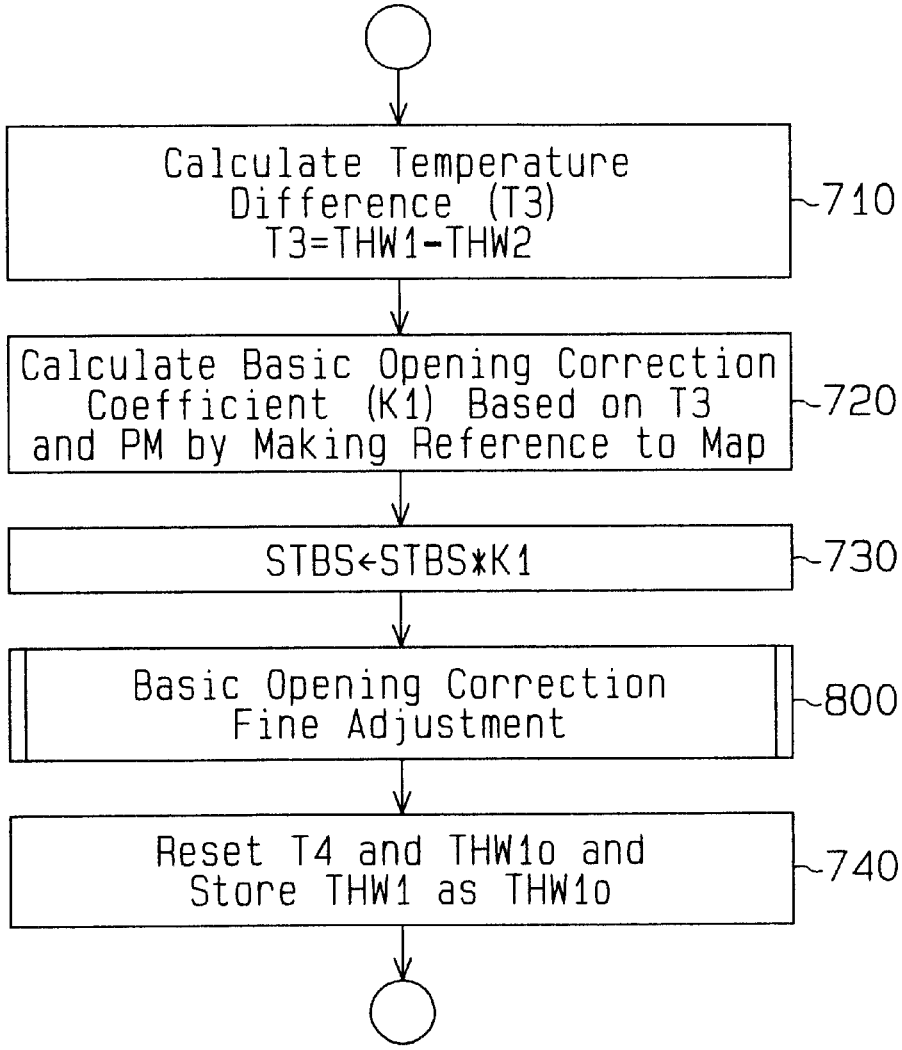
FIG. 15 is a flowchart showing a subroutine of the basic opening setting.

In the flowchart shown in FIG. 14, in step 600, the ECU 30 first reads values of the engine outlet coolant temperature THW1 and the radiator outlet coolant temperature THW2 detected by the first coolant temperature sensor 31 and the second coolant temperature sensor 32.

Then, in step 610, the ECU 30 calculates a value of the basic opening STBS based on values of the currently read engine speed NE and intake pressure PM by making reference to a predetermined basic opening map.

Subsequently, in step 700, the ECU 30 performs the basic opening correction. The processing content in step 700 will now be described in detail with reference to FIG. 15.

In step 710, the ECU 30 first calculates as a temperature difference T3 a difference between the value of the engine outlet coolant temperature THW1 and the value of the radiator outlet coolant temperature THW2 that have been currently read.

Then, in step 720, the ECU 30 calculates a value of the basic opening correction coefficient K1 based on the values of the temperature difference T3 and the intake pressure PM by making reference to a predetermined correction coefficient map. Here, the basic opening correction coefficient K1 is set to a value that falls within a range of "0<K1<1", and it is set so as to be relatively small as the temperature difference T3 relatively becomes large.

Subsequently, in step 730, the ECU 30 calculates the corrected basic opening STBS by multiplying the currently calculated value of the basic opening STBS by the basic opening correction coefficient K1.

$$STBS \leftarrow STBS * K1 \quad (3)$$

Then, in step 800, the ECU 30 performs the basic opening correction fine adjustment. Thereafter, in step 740, the ECU 30 resets the respective memories for a value of the later-described temperature change T4 and a value of the previous engine outlet coolant temperature THW1o, and sets the value of the current engine outlet coolant temperature THW1 in the memory as a value of the previous engine outlet coolant temperature THW1o.

Figure 16:
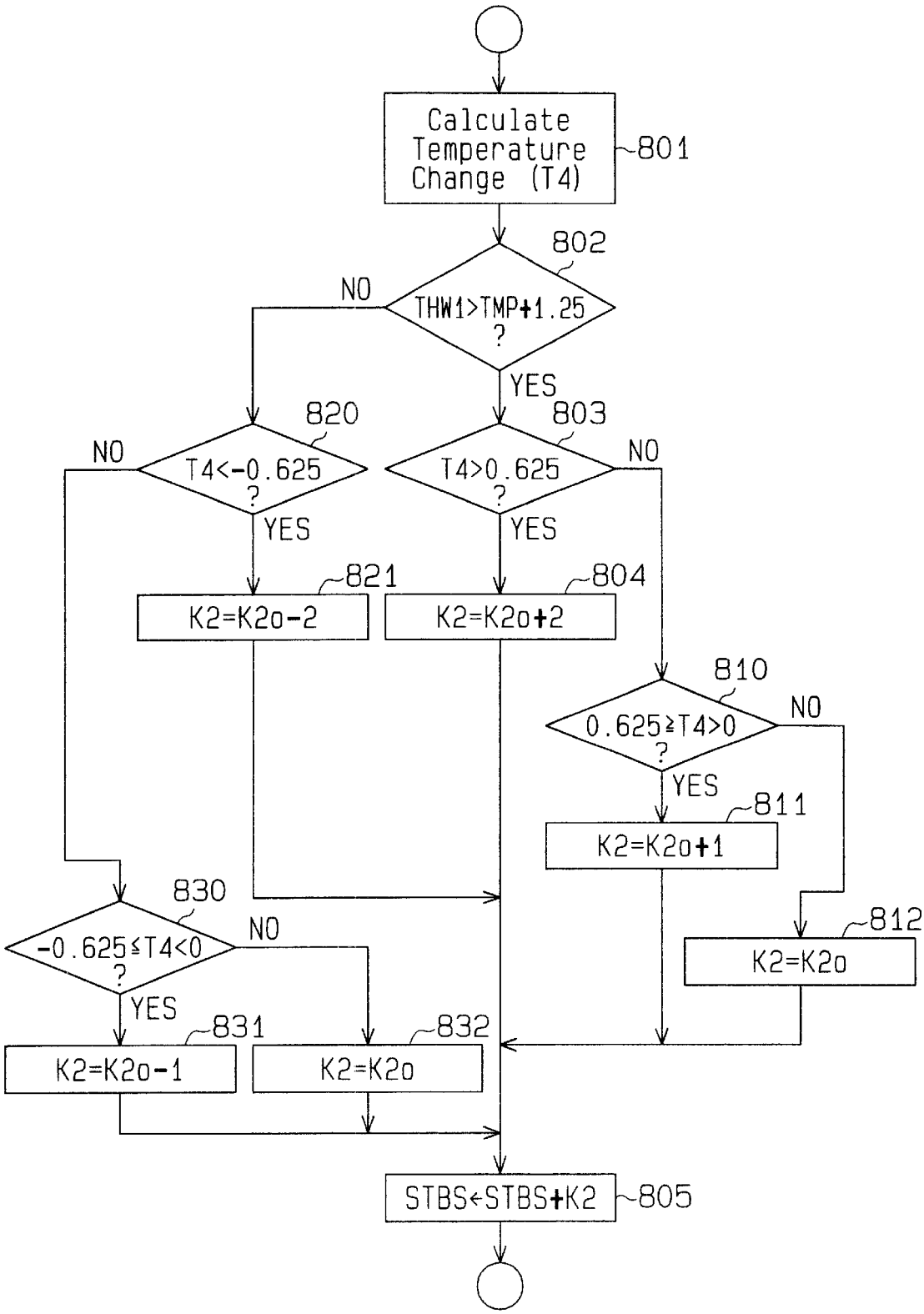
FIG. 16 is a flowchart showing a subroutine of the basic opening setting.

Here, detailed description will be given of the basic opening correction fine adjustment in step 800 with reference to FIG. 16. In step 801, the ECU 30 first calculates a difference between the value of the current engine outlet coolant temperature THW1 and the value of the previous engine outlet coolant temperature THW1o as a temperature change T4.

Then, in step 802, the ECU 30 judges whether the value of the current engine outlet coolant temperature THW1 is larger than a value obtained by adding, e.g., "1.25" to the value of the currently set target temperature TMP.

If a result of the judgment is positive, the ECU 30 judges whether the value of the temperature change T4 is larger than, e.g., "0.625" in step 803. If a result of this judgment is positive, the ECU 30 sets the value obtained by adding "2" to a previous fine adjustment value K2o as a current fine adjustment value K2 in step 804.

Then, in step 805, the ECU 30 provides a value of the basic opening STBS subjected to the fine adjustment by adding the fine adjustment value K2 to the currently corrected basic opening STBS.

On the other hand, if a result of the judgment in step 803 is negative, the ECU 30 judges whether the value of the current temperature change T4 falls within a range larger than "0" and not more than "0.625" in step 810. If a result of this judgment is positive, the ECU 30 sets the value obtained by adding "1" to the previous fine adjustment value K2o as the current fine adjustment value K2 in step 811. If a result of this judgment is negative, the ECU 30 sets the previous fine adjustment value K2o as the current fine adjustment value K2 in step 812.

Thereafter, the ECU 30 advances from step 811 or step 812, and executes the processing in step 805 in the same manner as described above.

On the other hand, if a result of the judgment in step 802 is negative, the ECU 30 judges whether the current temperature change T4 is smaller than, e.g., "−0.625" in step 820. If a result of this judgment is positive, the ECU 30 sets the value obtained by subtracting "2" from the previous fine adjustment value K2o as the current fine adjustment value K2 in step 821. Thereafter, the ECU 30 executes the processing in step 805 in the same manner as described the above.

Further, if a result of the judgment in step 820 is negative, the ECU 30 judges whether the value of the current temperature change T4 falls within a range smaller than "0" and not less than "−0.625" in step 830. If a result of this judgment is positive, the ECU 30 sets the value obtained by subtracting "1" from the previous fine adjustment value K2o as the current fine adjustment value K2 in step 831. If a result of this judgment is negative, the ECU 30 sets the previous fine adjustment value K2o as the current fine adjustment value K2 in step 832.

Thereafter, the ECU 30 advances from step 831 or step 832 and executes the processing in step 805 in the same manner as described above.

The value of the thus corrected and finely adjusted basic opening STBS is used for calculating the final opening STF in step 230 in the flowchart of FIG. 4.

According to the engine cooling apparatus of this embodiment described above, a value of the basic opening STBS is calculated based on a value of the engine speed NE and a value of the intake pressure PM. Furthermore, a difference between a value of the engine outlet coolant temperature THW1 and a value of the radiator outlet coolant temperature THW2 is calculated as a temperature difference T3. A value of the basic opening correction coefficient K1 is calculated based on the value of the temperature difference T3 and the value of the intake pressure PM, and the value of the basic opening STBS is corrected and set based on the value of the correction coefficient K1. Moreover, the value of the corrected basic opening STBS is subjected to fine adjustment by using the fine adjustment value K2 obtained in accordance with a temperature change T4 of the engine outlet coolant temperature THW1, thereby setting the basic opening STBS after correction fine adjustment. Then, the value of the basic opening STBS subjected to the correction fine adjustment is used for the feedback control of the flow regulating valve 8 as a feedforward term. T describe in detail, when the value of the temperature difference T3 is relatively large, an amount of heat radiated from the radiator 7 is large as compared with the case when the temperature difference T3 is small. Here, when the value of the temperature difference T3 is relatively large, the opening of the flow regulating valve 8 is caused to approximate the prospective opening on the closed side so as to suppress heat radiation from the radiator 7 based on the value of the basic opening STBS after correction. Therefore, the coolant temperature control can be appropriately performed irrespective of the temperature difference T3 between the engine outlet coolant temperature THW1 and the radiator outlet coolant temperature THW2, and the coolant temperature of the engine 1 can be adequately adjusted to a target temperature TMP.

Next, a sixth embodiment embodying the engine cooling apparatus according to the present invention will now be described in detail with reference to the drawings.

Figure 17:
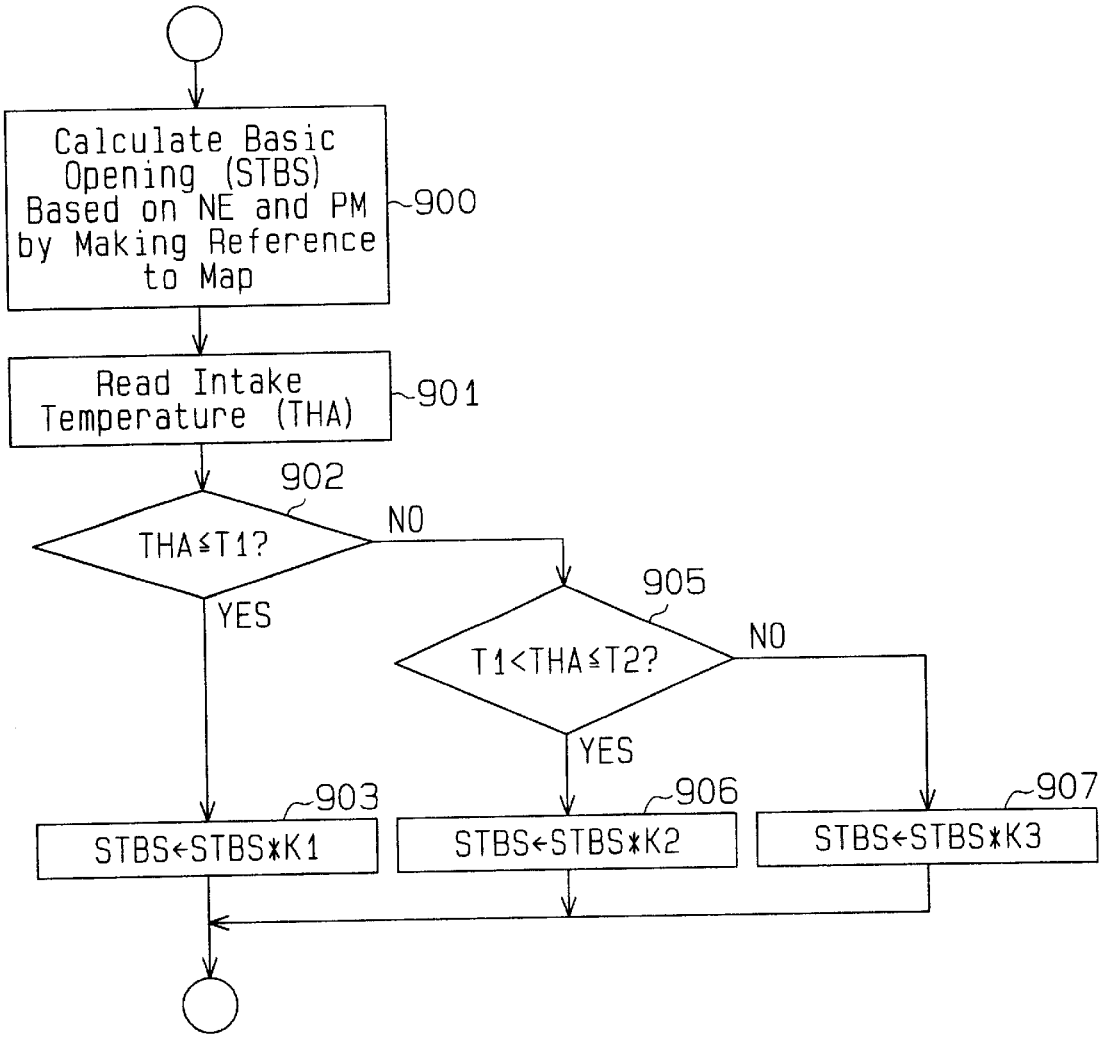
FIG. 17 is a flowchart showing a subroutine of the basic opening setting according to a sixth embodiment of the present invention.

The structure of this embodiment is different from the structures of the first to fifth embodiments in the processing content in step 210 in the main routine illustrated in FIG. 4. Here, since an amount of heat radiated from the engine 1 or the radiator 7 can vary depending on the environmental condition in which the engine 1 or the engine cooling apparatus is placed, the coolant temperature control by the engine cooling apparatus must be adjusted in accordance with the environmental condition. That is, an amount of heat radiation from the engine 1 or the radiator 7 can vary depending on the outside air temperature condition. Therefore, when the outside air temperature is changed, the opening of the flow regulating valve 8, which is to be subjected to the feedback control, may possibly deviate from the appropriate opening, and the coolant temperature control may be inhibited at this moment. Thus, in this embodiment, the outside air temperature condition is measured, and correction required for the basic opening STBS is carried out in accordance with a result of this measurement. That content will now be described with reference to the subroutine shown in FIG. 17.

In step 900, the ECU 30 first calculates a value of the basic opening STBS based on values of the currently read engine speed NE and intake pressure PM by making reference to the basic opening map.

Then, in step 901, the ECU 30 reads a value of the intake air-temperature THA detected by the intake air-temperature sensor 37. Here, although the intake air-temperature THA is read as a value reflecting the outside air temperature, an outside intake-air temperature sensor may be provided so that an outside air temperature can be detected by the outside intake-air temperature sensor.

Next, in step 902, the ECU 30 judges whether the currently read intake air-temperature THA is equal to or lower than a predetermined value T1 (for example, "0° C.") corresponding to a low temperature. If a result of this judgment is positive, it is determined that the outside air temperature is a low temperature, and the ECU 30 corrects the value of the basic opening STBS by multiplying the value of the currently calculated basic opening STBS by the value (for example, "0.8") of the low-temperature correction coefficient K1 corresponding to the low temperature in step 903.

On the other hand, if a result of the judgment in step 902 is negative, the ECU 30 judges whether the current intake air-temperature THA falls within a range higher than the predetermined value T1 corresponding to the low temperature and equal to or lower than a predetermined value T2 corresponding to a high temperature in step 905. If a result of this judgment is positive, it is determined that the outside air temperature is a medium temperature (for example, "0 to 30° C."), and the ECU 30 corrects the value of the basic opening STBS by multiplying the value of the currently calculated basic opening STBS by a value of the medium temperature correction coefficient K2 (for example, "1.0") corresponding to a medium temperature in step 906.

Additionally, if a result of the judgment in step 905 is negative, it is determined that the outside air temperature is a high temperature (for example, "a value exceeding 30° C."), and the ECU 30 corrects the value of the basic opening STBS by multiplying the value of the currently calculated basic opening STBS by a value of a high temperature correction coefficient K3 (for example, "1.2") corresponding to a high temperature in step 907.

The value of the thus corrected basic opening STBS is used for calculating the final opening STF in step 230 in the flowchart of FIG. 4.

According to the engine cooling apparatus of this embodiment described above, the basic opening STBS is corrected based on the value of the correction coefficients K1, K2 and K3 set in accordance with an outside air temperature, and the value of the basic opening STBS after correction is used for the feedback control over the flow regulating valve 8 as a feedforward term. Here, although an amount of heat radiated from the engine 1 or the radiator 7 varies depending on the environmental state of the engine 1, i.e., the state of an outside air temperature, the basic opening STBS is corrected and set based on the intake air-temperature THA corresponding to an outside air temperature in this embodiment. To describe in detail, the basic opening STBS is corrected based on the correction coefficients K1, K2 and K3 set in accordance with a difference in the intake air-temperature THA. Here, when the intake air-temperature THA is lower than a predetermined value T1, an amount of heat radiated from the engine 1 or the radiator 7 increases as compared with that at an ordinary temperature. However, when the intake air-temperature THA is lower than the predetermined value T1, the value of the basic opening STBS is set in such a manner that the opening of the flow regulating valve 8 is set on the closed side as compared with the case when the intake air-temperature THA is higher than the predetermined value T1. As a result, when the intake air-temperature THA is lower than the predetermined value T1, the opening of the flow regulating valve 8 is caused to approximate the prospective opening on the closed side so as to suppress an amount of heat radiation from the radiator 7 based on the setting of the basic opening TSBS. Further, when the intake air-temperature THA is higher than a predetermined value T2, an amount of heat radiated from the engine 1 or the radiator 7 is decreased as compared with that at an ordinary temperature. However, when the intake air-temperature THA is higher than the predetermined value T2, the basic opening STBS is set in such a manner that the opening of the flow regulating valve 8 is set on the opened side as compared with the case when the intake air-temperature THA is lower than the predetermined value T2. As a result, when the intake air-temperature THA is higher than the predetermined value T2, the opening of the flow regulating valve 8 is caused to approximate the prospective opening on the opened side so as to increase a flow rate of the coolant passing through the radiator 7 based on the setting of the basic opening STBS. Therefore, the coolant temperature control can be adequately performed in accordance with the environmental state of the engine 1 irrespective of a difference in the outside air temperature in particular, and the coolant temperature of the engine 1 can be appropriately adjusted to the target temperature TMP.

A seventh embodiment embodying the engine cooling system according to the present invention will now be described in detail with reference to the accompanying drawings.

Figure 18:
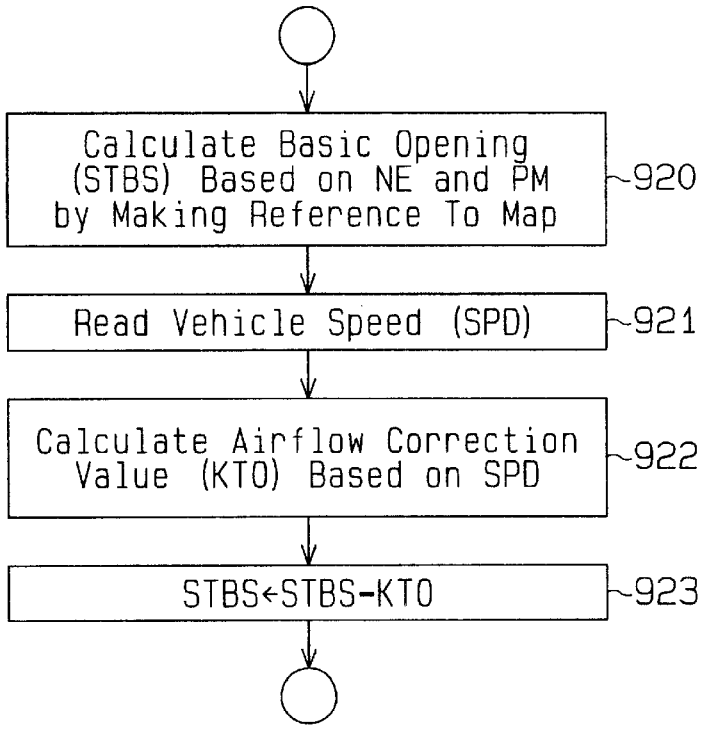
FIG. 18 is a flowchart showing a subroutine of the basic opening setting according to a seventh embodiment of the present invention.

The structure of this embodiment is different from those of the first to sixth embodiments in the processing content in step 210 in the main routine illustrated in FIG. 4. In this embodiment, the basic opening STBS is corrected in accordance with the environmental state as in the case of the sixth embodiment. In particular, the basic opening STBS is corrected in accordance with the strength of the airflow caused by the traveling vehicle, which influences heat radiation of the engine 1 or the radiator 7. That content will now be described with reference to the subroutine shown in FIG. 18.

In step 920, the ECU 30 calculates a value of the basic opening STBS based on values of the currently read engine speed NE and intake pressure PM by making reference to the basic opening map.

Then, in step 921, the ECU 30 reads a value of a vehicle speed SPD detected by a vehicle speed sensor 36. The value of the vehicle speed SPD is read as a value that correlates with the strength of the airflow caused by the traveling vehicle.

Then, in step 922, the ECU 30 calculates an airflow correction value KTO based on the value of the currently read vehicle speed SPD. Here, the airflow correction value KTO is set so as to increase as the vehicle speed SPD becomes higher.

Next, in step 923, the ECU 30 corrects the value of the basic opening STBSF by subtracting the currently obtained airflow correction value KTO from the value of the currently acquired basic opening STBS.

The value of the thus corrected basic opening STBS is used for calculating the final opening STF in step 230 in the flowchart of FIG. 4.

According to the engine cooling apparatus of this embodiment described above, the basic opening STBS is corrected based on the airflow correction value KTO according to the vehicle speed SPD, which correlates with the strength of the airflow caused by the traveling vehicle. Then, the basic opening STBS after correction is used for the feedback control over the flow regulating valve 8 as the feedforward term. Here, when the airflow caused by the traveling vehicle is strong, an amount of heat radiated from the engine 1 or the radiator 7 increases as compared with the case when the airflow is weak. Here, in this embodiment, the basic opening STBS is corrected based on the airflow correction value KTO according to the vehicle speed SPD, and the value of the basic opening STBS is set in such a manner that the opening of the flow regulating valve 8 is set on the closed side when the airflow caused by the traveling vehicle is strong as compared with the case when the airflow is weak. Therefore, when the airflow is strong, the opening of the flow regulating valve 8 is caused to approximate the prospective opening on the closed side so as to suppress heat radiation from the radiator 7 based on the setting of the basic opening STBS. Therefore, the coolant temperature control can be adequately performed irrespective of the strength of the airflow caused by the traveling vehicle, and the coolant temperature of the engine 1 can be appropriately adjusted to the target temperature TMP.

It should be noted that the present invention is not restricted to each of the foregoing embodiments and a part of the structure can be appropriately changed and embodied without departing from the scope of the invention.

(1) The schematic block diagram shown in FIG. 1 is merely an example, and the present invention can be embodied into an engine cooling apparatus having no cooling passage 16, which is used for cooling down the throttle body 14 or the EGR valve 15.

(2) In each of the foregoing embodiments, the "initial opening setting processing" of the flow regulating valve 8 is configured to be executed when the ignition switch (IGSW) 35 is turned on. However, when the "initial opening setting processing" of the flow regulating valve 8 can be configured to be executed when the starter switch is turned on.

(3) In each of the foregoing embodiments, although a value of the target temperature TMP is set based on the engine load, a value of the target temperature TMP can be variably set based on the engine load and the engine speed NE. In this case, the degree of cooling the engine 1 can be finely adjusted.

Further, in each of the foregoing embodiments, although a value of the target temperature TMP is set in three stages based on the engine load, it may be variably set in five stages. On the contrary, the target temperature TMP may be set to the same value in both the partially loaded operation with the medium load and the idle operation, and it may be variably set in two stages.

(4) In the sixth embodiment, the respective correction coefficients K1, K2 and K3 are set by making judgment upon which temperature range the value of the intake air-temperature THA corresponding to an outside air temperature falls within, and the value of the basic opening STBS is corrected. On the contrary, as illustrated in the seventh embodiment, the correction coefficient may be set so as to become large as the intake air-temperature THA increases based on a value of the intake air-temperature THA, and a value of the basic opening STBS may be multiplied by this correction coefficient, thereby correcting the value of the basic opening STBS.

Furthermore, in the seventh embodiment, the airflow correction value KTO increases as the vehicle speed SPD becomes high. The value of the basic opening STBS is corrected based on the airflow correction value KTO. On the contrary, as illustrated in the sixth embodiment, the correction value may be set by making judgment upon which vehicle speed range the value of the vehicle speed SPD falls within, and the correction value may be subtracted from the value of the basic opening STBS, thereby correcting the value of the basic opening STBS.

Moreover, in the seventh embodiment, although the airflow correction value KTO is obtained based on the value of the vehicle speed SPD detected by the vehicle sensor 36, an airflow speed sensor, which measures the speed of the airflow as its strength, may be provided and the airflow correction value KTO may be obtained based on the value of the airflow speed detected by the airflow speed sensor. In addition, the basic opening STBS may be corrected by using both the respective correction coefficients K1, K2 and K3 and the airflow correction value KTO.

Figure 19:
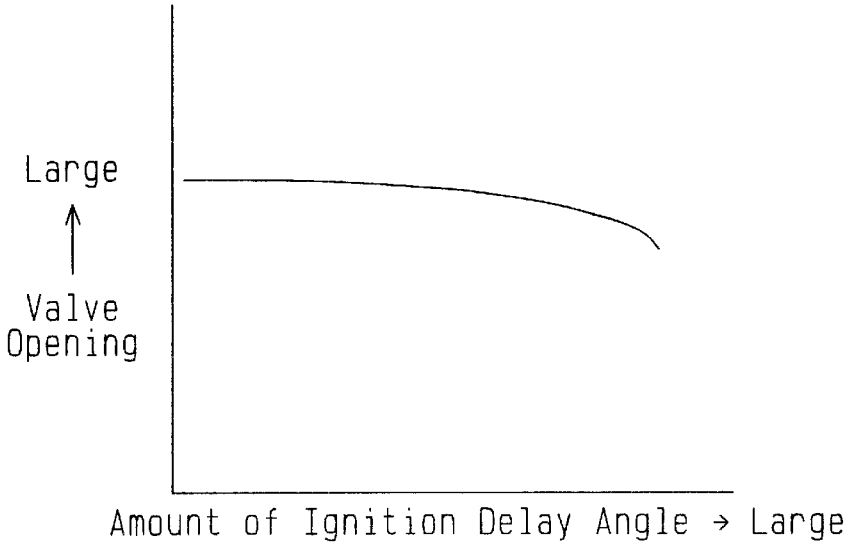
FIG. 19 is a graph showing the relationship between the valve opening and an ignition delay amount according to another embodiment of the present invention.

(5) In the third embodiment, the basic opening STBS is set in accordance with the combustion state (combustion mode) of the engine 1. On the contrary, as shown in FIG. 19, a value of the basic opening STBS may be set in such a manner that the opening of the flow regulating valve 8 is more on the closed side as an amount of ignition delay of the engine 1 increases as compared with the case when this amount lowers. In this case, although an amount of heat radiation of the engine 1 is reduced when an amount of the ignition delay is large as compared with the case when this amount is small, when an amount of the ignition delay is large, the opening of the flow regulating valve 8 is caused to approximate the prospective opening that is on the closed side so as to suppress heat radiation from the radiator 7 based on the setting of the value of the basic opening STBS. Therefore, the coolant temperature control can be appropriately performed irrespective of a difference in an amount of ignition delay, and the coolant temperature of the engine 1 can be adequately adjusted to the target temperature TMP.

Figure 20:
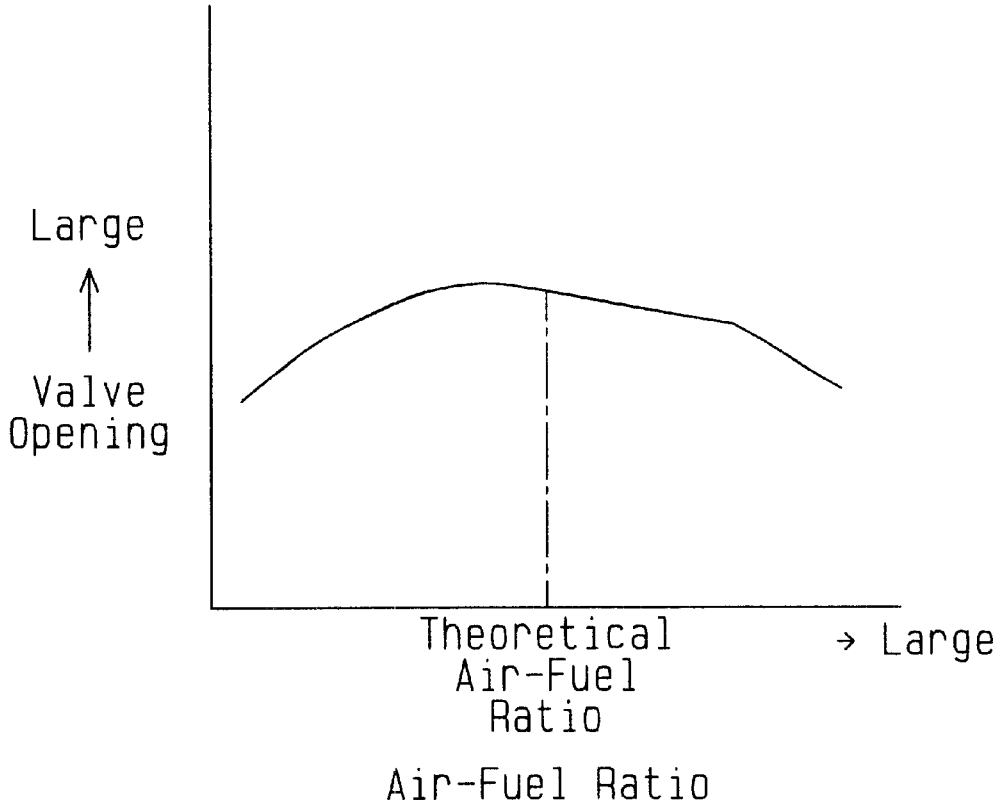
FIG. 20 is a graph showing the relationship of the valve opening relative to an air-fuel ratio according to another embodiment of the present invention.

(6) In the third embodiment, the basic opening STBS is set in accordance with the combustion state (combustion mode) of the engine 1. On the contrary, as shown in FIG. 20, when an air-fuel ratio of the engine 1 is excessively higher or lower than a theoretical air-fuel ratio, a value of the basic opening STBS may be set in such a manner that the opening of the flow regulating valve 8 is more on the closed side as compared with the case of the theoretical air-fuel ratio. As compared with the case of the theoretical air-fuel ratio, the amount of heat radiation of the engine 1 is reduced when the air-fuel ratio is excessively higher or lower than the theoretical air-fuel ratio. However, when the air-fuel ratio is excessively higher or lower than the theoretical air-fuel ratio, the opening of the flow regulating valve 8 is caused to approximate the prospective opening that is on the closed side so as to suppress heat radiation from the radiator 7 based on the setting of the value of the basic opening STBS. Therefore, the coolant temperature control can be appropriately performed irrespective of a difference in an air-fuel ratio, and the coolant temperature of the engine 1 can be adequately adjusted to the target temperature TMP.

What is claimed is:

1. An engine cooling apparatus, comprising:

a circulation passage extending through an engine, wherein coolant flows through the circulation passage;

a radiator provided in the circulation passage, wherein the radiator cools coolant passing through the circulation passage;

a flow regulating valve, which regulates the flow rate of coolant flowing through the radiator; and a controller for controlling the flow regulating valve, wherein the controller sets a feedforward term, which corresponds to a basic opening of the flow regulating valve, based on the operation state of the engine, wherein the controller sets a feedback term, the feedback term being adjusted such that the engine coolant temperature, which is the temperature of coolant flowing through the engine, converges on a predetermined target value, and wherein the controller feedback controls the opening of the flow regulating valve based on the feedforward term and the feedback term.

2. The cooling apparatus according to claim 1, wherein, when start operation of the engine is detected, the controller starts controlling the flow regulating valve.

3. The cooling apparatus according claim 2, wherein the controller detects the start operation when an ignition switch is turned on, the ignition switch being operated to start and stop the engine.

4. The cooling apparatus according to claim 2, wherein, if the engine coolant temperature is higher than a predetermined value when the start operation is detected, the controller sets the opening of the flow regulating valve greater than when the engine coolant temperature is less than the predetermined value.

5. The cooling apparatus according to claim 4, wherein, if the engine coolant temperature is greater than the predetermined value when the start operation is detected, the controller fully opens the flow regulating valve.

6. The cooling apparatus according to claim 4, wherein, if the engine coolant temperature is less than the predetermined value when the start operation is detected, the controller fully closes the flow regulating valve.

7. The cooling apparatus according to claim 1, wherein the controller sets an initial value of the feedback term based on the state of the engine when the engine is started.

8. The cooling apparatus according to claim 7, wherein, when the engine coolant temperature is greater than a predetermined value, the controller sets the initial value such that the initial value affects the opening of the flow regulating valve in a direction that relatively increases the opening compared to a case in which the engine coolant temperature is less than the predetermined value.

9. The cooling apparatus according to claim 1, wherein the controller sets the target value of the engine coolant temperature based on the operation state of the engine.

10. The cooling apparatus according to claim 9, wherein, when the engine load is higher than a predetermined value, the controller sets the target value lower than a case in which the engine load is lower than the predetermined value.

11. The cooling apparatus according to claim 9, wherein, when the engine is in the idle, the controller sets the target value lower than a case in which the engine is in a partially loaded operation.

12. The cooling apparatus according to claim 9, wherein the controller previously stores a plurality of items of data, each of which corresponds to one of different values of the target value and sets a relationship between the engine operation state and the feedforward term, wherein the controller computes the feedforward term using the data that corresponds to the set target value.

13. The cooling apparatus according to claim 1, wherein the controller sets the feedforward term based on the operation state of a heater, which uses heat generated in the engine.

14. The cooling apparatus according to claim 13, wherein, when the heater is operating, the controller sets the feedforward term such that the opening of the flow regulating valve is relatively small compared to a case in which the heater is not operating.

15. The cooling apparatus according to claim 14, wherein, when the heater is operating, the controller sets the feedforward term such that the opening of the flow regulating valve is relatively decreased as the engine speed is decreased.

16. The cooling apparatus according to claim 1, wherein the controller sets the feedforward term based on the combustion state of the engine.

17. The cooling apparatus according to claim 16, wherein the engine operates in a combustion mode selected at least from a stratified combustion mode and a homogeneous combustion mode, wherein, when the engine is operating in the stratified combustion mode, the controller sets the feedforward term such that the opening of the flow regulating valve is relatively small compared to a case in which the engine is operating in the homogenous combustion mode.

18. The cooling apparatus according to claim 16, wherein the controller sets the feedforward term such that the opening of the flow regulating valve is relatively decreased as the ignition delay amount of the engine is increased.

19. The cooling apparatus according to claim 16, wherein, when the air-fuel ratio of the air-fuel mixture drawn into the engine is not the theoretical air-fuel ratio, the controller sets the feedforward term such that the opening of the flow regulating valve is relatively small compared to a case in which the air-fuel ratio is the theoretical air-fuel ratio.

20. The cooling apparatus according to claim 17, wherein the controller sets the feedforward term based on the cooling state of the coolant by the radiator.

21. The cooling apparatus according to claim 20, wherein the controller sets the feedforward term such that the opening of the flow regulating valve is relatively decreased as the temperature of the coolant flowing through the radiator is decreased.

22. The cooling apparatus according to claim 20, wherein the controller sets the feedforward term such that the opening of the flow regulating valve is relatively decreased as the difference between the engine coolant temperature and the temperature of the coolant flowing through the radiator is increased.

23. The cooling apparatus according to claim 1, wherein the controller sets the feedforward term based on the environmental condition in which the engine is placed.

24. The cooling apparatus according to claim 23, wherein the controller sets the feedforward term such that the opening of the flow regulating valve is relatively decreased as the outside temperature is decreased.

25. The cooling apparatus according to claim 23, wherein the controller sets the feedforward term such that the opening of the flow regulating valve is relatively decreased as the strength of the airflow caused when the vehicle is moving is increased.

26. The cooling apparatus according to claim 1, wherein, when the engine coolant temperature is less than a predetermined value, the controller prohibits updating of the feedback term and performs an open loop control to set the opening of the flow regulating valve.

27. The cooling apparatus according to claim 26, wherein the controller sets the opening of the flow regulating valve based on the engine coolant temperature in the open loop control such that, when the feedback control is started after the open loop control, the opening of the flow regulating valve is equal to a predetermined opening.

28. A method for controlling an engine cooling apparatus, wherein the apparatus includes a coolant circulation passage extending through an engine, wherein the method comprising:

cooling coolant passing through the circulation passage with a radiator provided in the circulation passage;

regulating the flow rate of coolant flowing through the radiator with a flow regulating valve;

setting a feedforward term based on the operation state of the engine, the feedforward term corresponding to a basic opening of the flow regulating valve;

setting a feedback term, the feedback term being adjusted such that the engine coolant temperature, which is the temperature of coolant flowing through the engine, converges on a predetermined target value; and feedback controlling the opening of the flow regulating valve based on the feedforward term and the feedback term.

* * * * *